US006161926A

United States Patent [19]

Shigemura et al.

[11] Patent Number: 6,161,926

[45] **Date of Patent: *Dec. 19, 2000**

[54] INK JET RECORDING DEVICE MADE OF A DIELECTRIC POLARIZED MATERIAL

[75] Inventors: Koji Shigemura; Takashi Ota, both of Tokyo, Japan

[73] Assignee: NEC Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/731,017

[22] Filed: Oct. 9, 1996

[30] Foreign Application Priority Data

Oct. 9, 1995 [JP] Japan ..... 7-261896

[51] Int. Cl.[7] ..... B41J 2/045

[52] U.S. Cl. ..... 347/71

[58] Field of Search ..... 347/68–72, 10, 347/11; 29/25, 35; 310/328, 330, 357, 359, 363

[56] References Cited

U.S. PATENT DOCUMENTS

| | | | |
|---|---|---|---|
| 4,752,788 | 6/1988 | Yasuhara et al. | 346/140 R |
| 4,887,100 | 12/1989 | Michaelis et al. | 347/69 |
| 5,227,813 | 7/1993 | Pies et al. | 347/71 |
| 5,351,375 | 10/1994 | Ochiai et al. | 347/71 X |
| 5,471,231 | 11/1995 | Hiraishi et al. | 347/68 |
| 5,552,809 | 9/1996 | Hosono et al. | 347/10 |
| 5,590,451 | 1/1997 | Katsuumi et al. | 347/71 X |
| 5,787,558 | 8/1998 | Murphy | 347/69 X |
| 5,801,731 | 9/1998 | Takahashi | 347/69 |
| 5,997,135 | 12/1999 | Sugahara | 347/69 X |

FOREIGN PATENT DOCUMENTS

| | | |
|---|---|---|
| 0624473 | 11/1994 | European Pat. Off. . |
| 064646 | 4/1995 | European Pat. Off. . |
| 53-12138 | 4/1978 | Japan . |
| 61-59913 | 12/1986 | Japan . |
| 62-56150 | 3/1987 | Japan . |
| 63-252750 | 10/1988 | Japan . |
| 5-338147 | 12/1993 | Japan . |

OTHER PUBLICATIONS

Patent Abstracts of Japan, vol. 94, No. 12, Dec. 20, 1994.
Patent Abstracts of Japan, vol. 95, No. 002, Feb. 21, 1995.
Patent Abstracts of Japan, vol. 18, No. 173 (M–1581), Mar. 24, 1994.
Patent Abstracts of Japan, vol. 011, No. 247 (M–615), Aug. 12, 1987.

*Primary Examiner*—John Barlow
*Assistant Examiner*—C. Dickens
*Attorney, Agent, or Firm*—Sughrue, Mion, Zinn, Macpeak & Seas, PLLC

[57] ABSTRACT

A multinozzle ink jet recording device having a dense arrangement and a method of producing the same are disclosed. Two electrodes for applying a voltage to the side walls of a piezoelectric plate lie in the range of a pressure chamber, so that an electric field is prevented from acting on portions which do not contribute to the ejection of an ink drop. This obviates the waste of voltage and thereby realizes low voltage drive which reduces the size of the pressure chamber. All the grooves serve as pressure chambers without any slit or similar wasteful space intervening between them. Thus the multinozzle print head has a dense configuration. With such a print head, the recording device achieves a miniature and compact arrangement.

35 Claims, 27 Drawing Sheets

INK JET RECORDING DEVICE MADE OF A DIELECTRIC POLARIZED MATERIAL

BACKGROUND OF THE INVENTION

The present invention relates to an ink jet recording device and a method of producing the same and, more particularly, to a multinozzle ink jet recording device having a dense arrangement and applicable to a printer, facsimile, copier or similar image forming apparatus, and a method of producing the same.

Ink jet recording devices for the above application are generally classified into two types, a thermal ink jet or bubble jet type and a piezoelectric type with respect to a drive source for ink ejection. A thermal ink jet or bubble jet type device is taught in, e.g., Japanese Patent Publication No. 61-59913. This type of device includes a thermal head having a plurality of thermal elements arranged thereon. Pressure chambers are each associated with the respective thermal element. Nozzles and ink passages are communicated to the pressure chambers. In operation, power is selectively applied to the thermal elements so as to heat ink existing thereon, thereby producing bubbles. As a result, the ink is ejected via the nozzles by the pressure of the bubbles.

The above thermal head or drive source implements a dense multinozzle print heat because it can be fabricated by photolithography. An ink jet recording device with such a print head is miniature and operable at a high speed. However, the problem with this type of device is that the ink must be heated to above 300° C. for producing bubbles. When the ink is ejected over a long period of time, the components of the ink deposit on the thermal elements and bring about defective ejection. Moreover, it is likely that the print head is damaged by thermal stress and cavitation or effected by passivation ascribable to pinholes existing in the protection layer of the thermal elements. For the above reasons, it i s difficult to provide the print head with a long service life.

A piezoelectric type ink jet recording device is disclosed in, e.g., Japanese Patent Publication No. 53-12138 and includes pressure chambers communicated to nozzles and ink passages. Piezoelectric elements cause the volumes of the pressure chambers to vary. In operation, a voltage is selectively applied to the piezoelectric elements so as to cause the volumes of the pressure chambers to vary. As a result, ink drops are ejected from the pressure chambers. This type of device is operable with a broad range of ink and has a long life. However, the problem is that it is difficult to arrange a number of piezoelectric elements in a dense configuration, making it difficult to implement a miniature high-speed ink jet recording device.

Japanese Patent Laid-Open Publication Nos. 62-56150, 63-252750 and 5-338147 each proposes an ink jet recording device for solving the above problem. However, none of the proposals can solve problems which will be described later.

SUMMARY OF THE INVENTION

It is therefore an object of the present invention to provide a new and useful ink jet recording device capable of solving all the problems particular to the conventional devices.

In accordance with the present invention, an ink jet recording device includes a plurality of pressure chambers each being delimited, at both sides thereof, by side walls of a dielectric body polarized in an up-and-down direction and flexible in an upper portion thereof. Electrodes are respectively positioned on the upper and lower surfaces of each of the side walls. A plurality of nozzles are each fluidly communicated to the respective pressure chamber. A control system is electrically connected to the electrodes for applying an electric field in the same direction as the polarization of the side walls.

Also, in accordance with the present invention, a method of producing an ink jet recording device has the steps of forming electrodes on the upper and lower surfaces of a piezoelectric body, adhering the piezoelectric body and an under plate, forming a plurality of grooves in the piezoelectric body and under plate throughout an interface thereof, forming a protection layer for the electrodes after the grooves have been formed, and adhering a nozzle plate and a top plate after the projection layer has been formed.

Further, in accordance with the present invention, a method of producing an ink jet recording device has the steps of patterning electrodes on the upper surface of a piezoelectric body, forming an electrode on the lower surface of the piezoelectric body, adhering an under plate to the piezoelectric body, forming a plurality of grooves in the piezoelectric body and under plate throughout an interface thereof, forming a protection layer for the electrodes after the grooves have been formed, and adhering a nozzle plate and a top plate after the protection layer has been formed.

Moreover, in accordance with the present invention, a method of producing an ink jet recording device has the steps of forming electrodes on the upper surface of a piezoelectric body, forming an electrode on the upper surface of an under plate, adhering the piezoelectric body and under plate, forming a plurality of grooves in the piezoelectric body and under plate throughout an interface thereof, forming a protection layer for the electrodes after the grooves have been formed, and adhering a nozzle plate and a top plate after the protection layer has been formed.

In addition, in accordance with the present invention, a method of producing an ink jet recording device has the steps of patterning electrodes on the upper surface of a piezoelectric body, forming an electrode on the upper surface of an under plate, adhering the piezoelectric body and under plate, forming a plurality of grooves in the piezoelectric plate and under plate throughout an interface thereof, forming a protection layer for the electrodes after the grooves have been formed, and adhering a nozzle plate and a top plate after the protection layer has been formed.

BRIEF DESCRIPTION OF THE DRAWINGS

The above and other objects, features and advantages of the present invention will become apparent from the following detailed description taken with the accompanying drawings in which.

In the figures, identical reference numerals designate identical structural elements.

DESCRIPTION OF THE PREFERRED EMBODIMENTS

Figure 28:
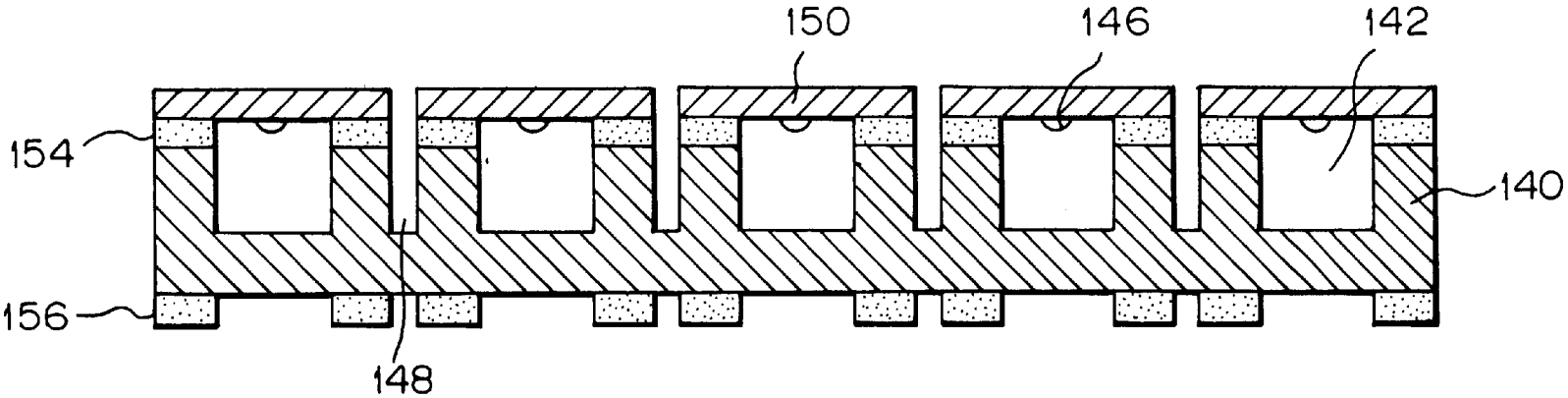
Fig. 28 PRIOR ART
FIGS. 28, 29 and 30 each shows a specific conventional ink jet recording device.

To better understand the present invention, a brief reference will be made to a conventional ink jet recording device, shown in FIG. 28 and taught in, e.g., Japanese Patent Laid-Open Publication No. 62-56150. As shown, the device has a single flat plate 140 formed of a piezoelectric material. Cavities 142 having the same depth, grooves 146 respectively communicated to the cavities 142 and ink feed grooves are formed in the piezoelectric plate 140. Also formed in the plate 140 are slits 148 each intervening between nearby cavities 142. Electrodes 154 are positioned on the front of the plate 140 around the cavities 142. Electrodes 156 are positioned on the rear of the plate 140 and respectively face the electrodes 154. A cover plate 150 is affixed to the plate 140, as illustrated. When a voltage is selectively applied to between the electrodes 154 and 156, the piezoelectric material intervening between them deforms and causes the cavities 142 to selectively vary in volume. As a result, ink drops are selectively ejected from the cavities 142.

The above conventional device has some problems yet to be solved, as follows. An electric field derived from the voltage acts also on the portions of the plate 140 between the bottoms of the cavities 142 and the rear of the plate 140, causing them to deform. The deformation of such portions of the plate 140 does not contribute to the discharge of the ink, reducing the efficiency of the device. For example, assume that the portions of the plate 140 between the bottoms of the cavities 142 and the rear of the plate 140 each has a thickness which is 30% of the overall thickness of the plate 140. Then, 30% of the voltage applied to between the electrodes 154 and 156 is simply wasted. Therefore, a voltage high enough to make up for the waste must be applied. This increases the cost of the device. Further, a displacement great enough for the discharge of the ink is not achievable unless each cavity or pressure chamber 142 has a great volume. In addition, 148 the slits 148 each intervening between nearby pressure chambers 142, abstruct the dense arrangement of the chambers 142.

Figure 29:
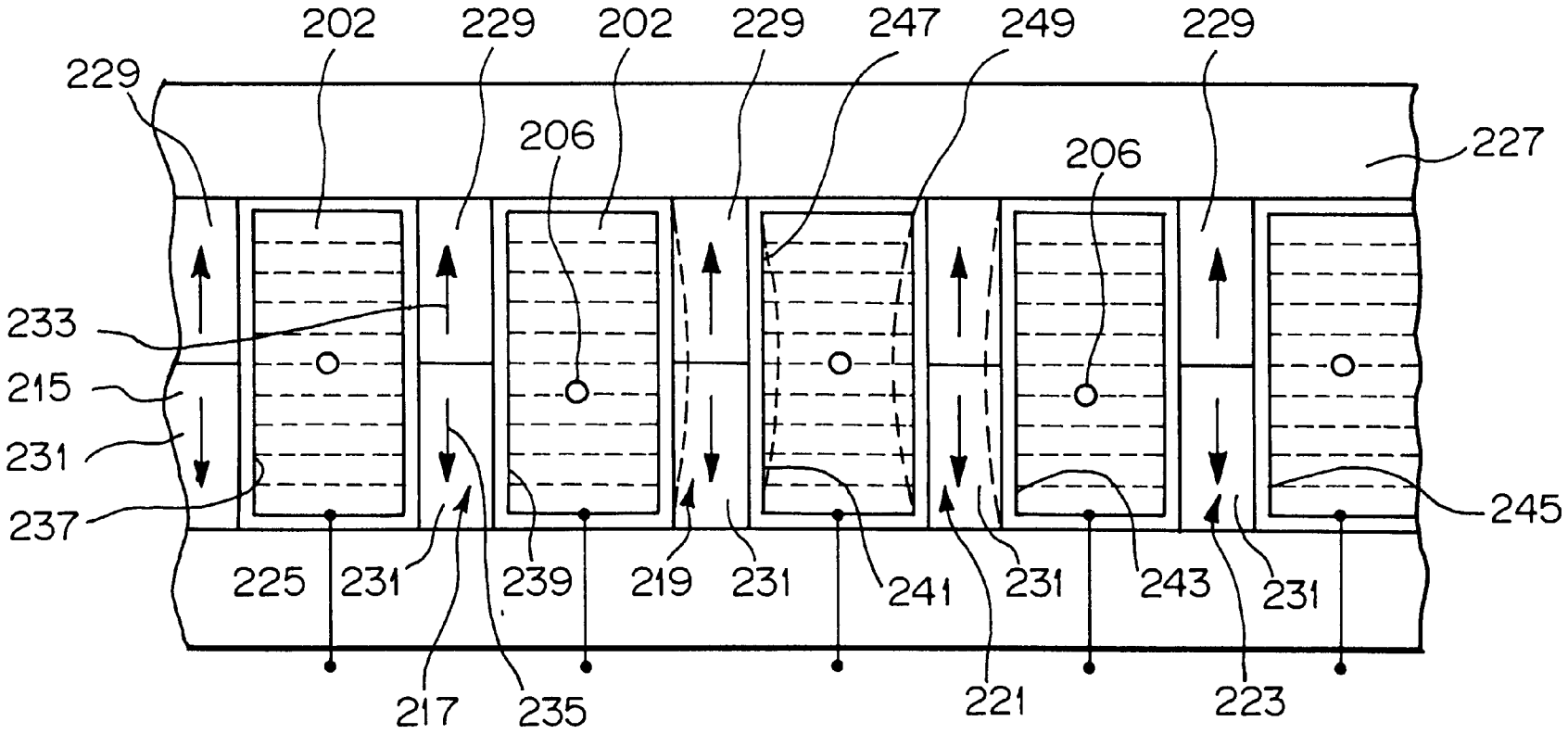
Fig. 29 PRIOR ART

FIG. 29 shows another conventional ink jet recording device disclosed in, e.g., Japanese Patent Laid-Open Publication No. 63-252750. As shown, the device has a top plate 227 and a bottom plate 225 sandwiching an array of passages 202. Each passage 202 is delimited by upper side walls 229 and lower side walls 231 positioned at opposite sides thereof. The side walls 229 and 231 adjoining each other in the vertical direction are polarized in opposite directions to each other, as indicated by arrows 233 and 235. In this configuration, the side walls 229 and 231 polarized in opposite directions constitute shear mode actuators 215, 217, 219, 221 and 223. Electrodes 237, 239, 241, 243 and 245 each covers the inner walls of the respective passage 202. In operation, when a voltage is applied to, e.g., the electrode 241 between the actuators 221 and 219, electric fields opposite in polarity are respectively applied to the actuators 219 and 221 because the electrodes 239 and 243 are connected to ground. Because the vertically aligned walls 229 and 231 are polarized in opposite directions to each other, they deform toward the associated passage 202 due to shear in convex configuration, as indicated by phantom lines 247 and 249. As a result, ink existing in the path between the actuators 219 and 221 is compressed and discharged via a nozzle 206.

A problem with the device shown in FIG. 29 is that it needs a complicated and costly procedure of manufacture. Specifically, electrodes are affixed the opposite sides of a piezoelectric ceramics sheet before grooves are formed in the sheet. Then, a voltage is applied to between the electrodes for polarization. Subsequently, the electrodes are separated from the sheet. Further, to prevent the polarization from being lost, the production process, materials and conditions for operation are limited. Specifically, during the formation of electrodes and protection layers and adhesion included in the process, high temperature is prohibited in order to preserve the polarization, resulting in the above limitations. For example, during the formation of electrodes and a protection layer, chemical vapor deposition (CVD) exhibiting an inherently high coverage effect is not usable because it elevates temperature. Moreover, it is difficult to adhere two piezoelectric ceramics sheet each having a number of grooves such that the apexes of the grooves align with each other. This is especially true when a dense arrangement is required.

Figure 30:
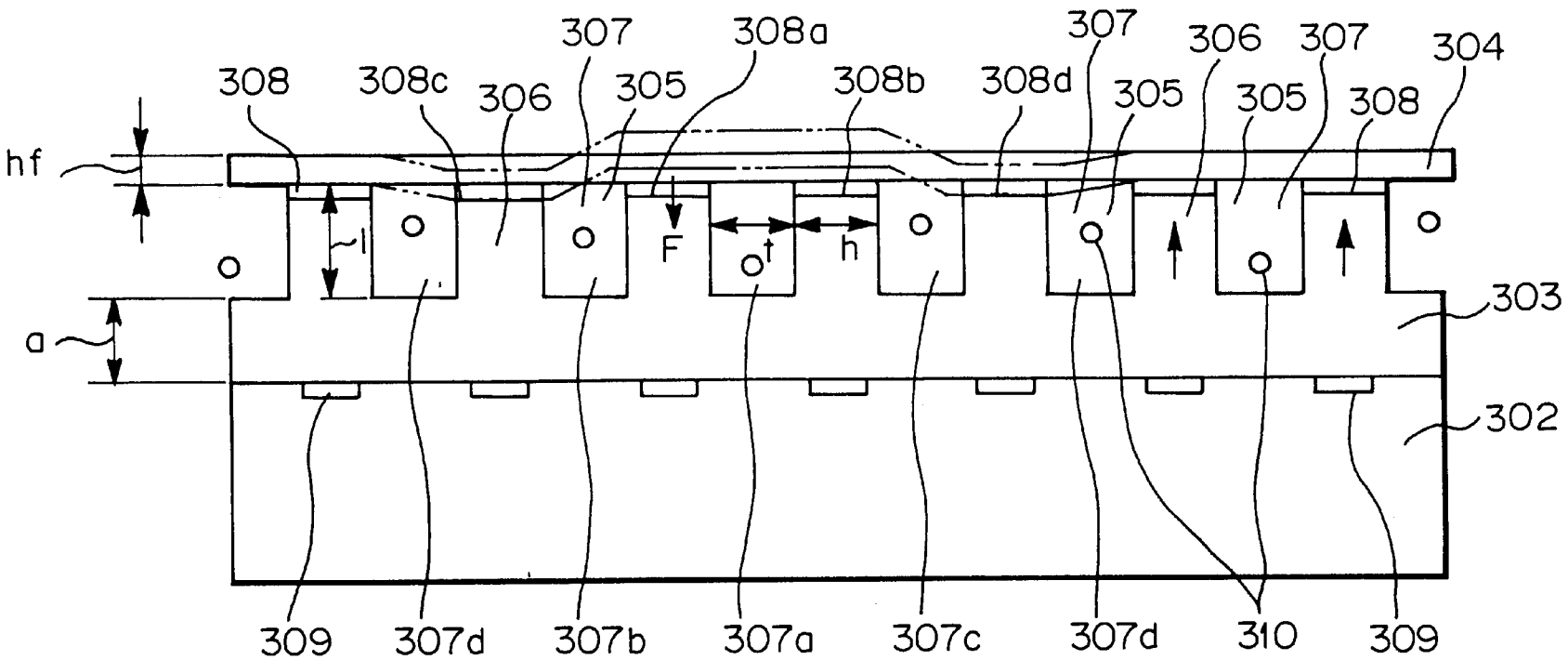
Fig. 30 PRIOR ART

FIG. 30 shows a further conventional ink jet recording device proposed in, e.g., Japanese Patent Laid-Open Publication No. 5-338147. As shown, the device has a substrate 302, a piezoelectric body 303 and a flexible sheet or film 304 laminated together. The flexible film 304 is formed of polyimide or similar resin. A number of grooves 305 and a number of side walls 306 are formed in the piezoelectric body 30 alternately in parallel to each other. The piezoelectric body 303 is polarized in the direction of the thickness thereof. Specifically, the side walls 306 are polarized in the direction parallel to the depth of the grooves 305, as indicated by arrows in FIG. 30. The film 304 covers the open ends of the grooves 305 and thereby forms a number of pressure chambers 307. Electrodes 308 are formed on the ends of the side walls 306 adjoining the film 304. Electrodes 309 each forming a pair with the respective electrode 308 are formed on the rear or bottom of the piezoelectric body 303. The end of each pressure chamber 307 is communicated to a respective orifice 310.

Assume that ink is to be ejected from a given pressure chamber 307*a* included in the pressure chambers 307. Also, assume that the pressure chambers next to the pressure chamber 307*a* are 307*b* and 307*c*, that electrodes 308*a* and 308*b* are positioned at both sides of the chamber 307*a*, and that electrodes 308*c* and 308*d* are positioned next to the electrodes 308*a* and 308*b*, respectively. Then, when a voltage +V is applied to between the electrodes 308*a* and 308*b* while a voltage −V is applied to between the electrodes 308*c* and 308*d*, the side walls 306 delimiting the chamber 307*a* expand upward while the side walls 306 next to the above side walls 306 contract. As a result, the film 304 is partly deformed upward by the expanding side walls 306, as indicated by a dash-and-dot line in FIG. 30. Therefore, the chamber 307*a* has its volume increased and sucks ink from an ink passage, not shown. Subsequently, the voltage is sharply interrupted or the polarity thereof is sharply switched, causing the expanded side walls 306 to sharply contract to their original positions. Consequently, the pressure inside the chamber 307*a* is sharply increased with the result that the ink is caused to fly out of the chamber 307*a* via the orifice.

This kind of approach is not satisfactory for the following reasons. The device needs voltage application control means for selectively applying voltages of opposite polarities, resulting in an increase in cost. Further, because the voltage is applied even in the direction opposite to the polarization, the electric field must be limited in order to prevent the polarization from being inverted. This obstructs desirably great deformation and requires each pressure chamber 307 to have a great volume. In addition, a high voltage and therefore a high cost are indispensable, as stated in relation to Laid-Open Publication No. 62-56150.

Figure 1:
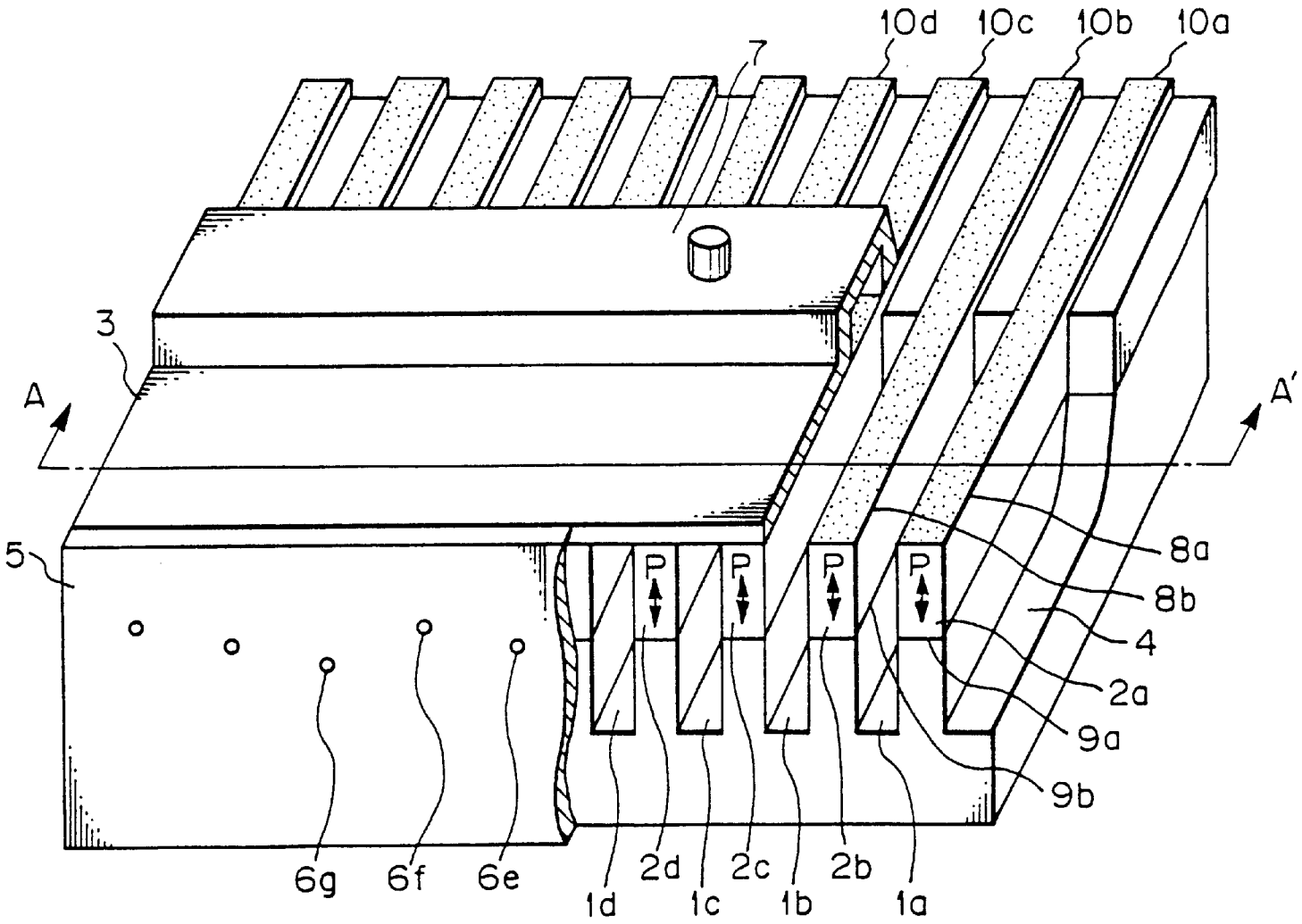
FIG. 1 shows an ink jet recording device in accordance with the present invention.

Referring to FIG. 1, an ink jet recording device in accordance with the present invention is shown. As shown, the device has a number of pressure chambers 1*a*, 1*b*, 1*c*, 1*d* and so forth (collectively 1). Side walls 2*a*, 2*b*, 2*c*, 2*d* and so forth (collectively 2) delimit the pressure chambers 1 and are formed of a piezoelectric material. Further, the pressure chambers 1 are surrounded by a top plate 3, an under plate 4, and a nozzle plate 5 which is positioned at one side of the chambers 1. The nozzle plate 5 is formed with nozzles 6*a*, 6 b, 6*c*, 6*d*, 6*e*, 6*f* and so forth (collectively 6; 6*a*–6*d* are not shown). The nozzles 6 are each connected to the respective pressure chamber 1. An ink pool 7 is communicated to the rear portions of the pressure chambers 1. Electrodes 8*a*, 8*b* and so forth (collectively 8) are respectively positioned on the upper ends of the side walls 2 while electrodes 9*a*, 9*b* and so forth (collectively 9) are respectively positioned on the lower ends of the side walls 2. The electrodes 8 are electrically connected to pads 10*a*, 10*b*, 10*c*, 10*d* and so forth (collectively 10), respectively. The electrodes 9 are electrically connected to a common electrode, not shown. The pressure chambers 1, nozzles 6 and ink pool 7 is filled with ink, not shown.

The portions of the electrodes 8 and 9 facing the pressure chambers 1 are covered with a protection layer, not shown, so as not to contact the ink. The side walls 2 are each polarized in the direction of its height, as indicated by arrows P. The top plate 3 is flexible.

The above structural elements of the embodiment have the following specific dimensions. The pressure chambers 1 have an inside width of 63.5 μm each. The side walls 2 are 100 μm high and 63.5 μm wide each. The nozzle plate 5 is 80 μm thick while the nozzles 6 have a diameter of 40 μm each. The length of each side wall 2 up to the ink pool 7 is 15 mm. The under plate 4 has groove portions which are 100 μm deep each. Therefore, each of the pressure chambers 1 has dimensions of 63.5 μm×200 μm×15 mm. The nozzles 6 are formed in the nozzle plate 5 at a pitch of 127 μm.

Figure 2A:
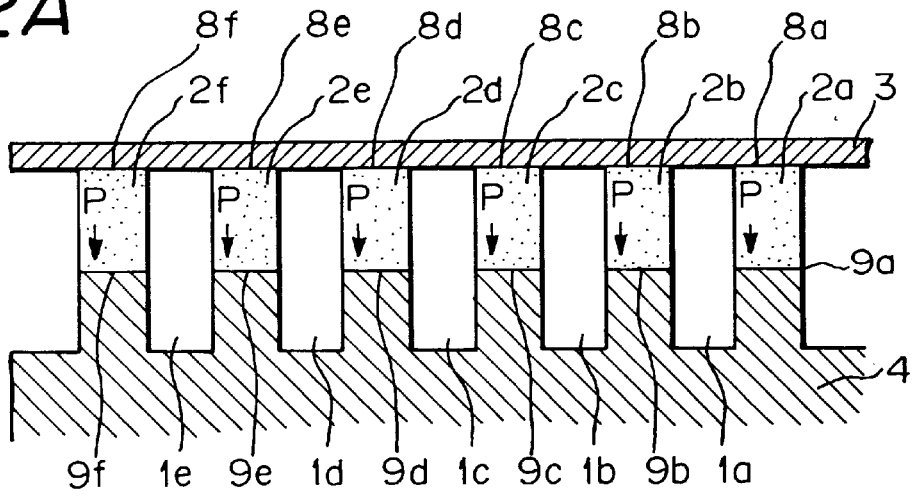
FIGS. 2A–2C are sections along line A–A' of FIG. 1 for describing the operation of the device shown in FIG. 1.
Figure 2B:
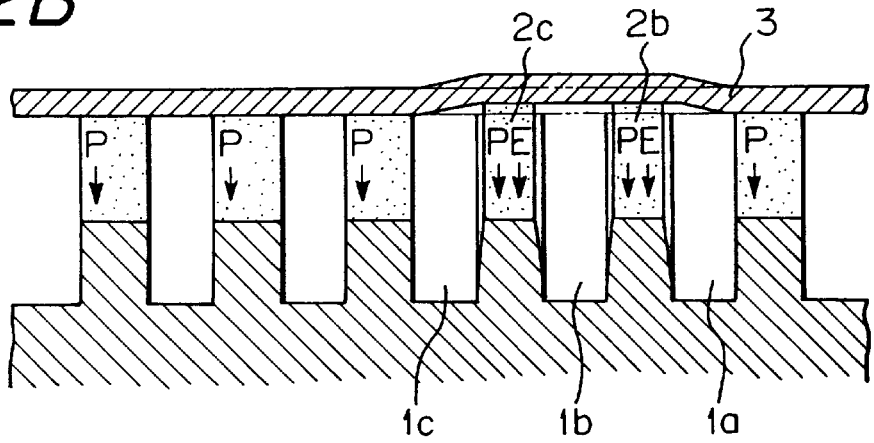
Figure 2C:
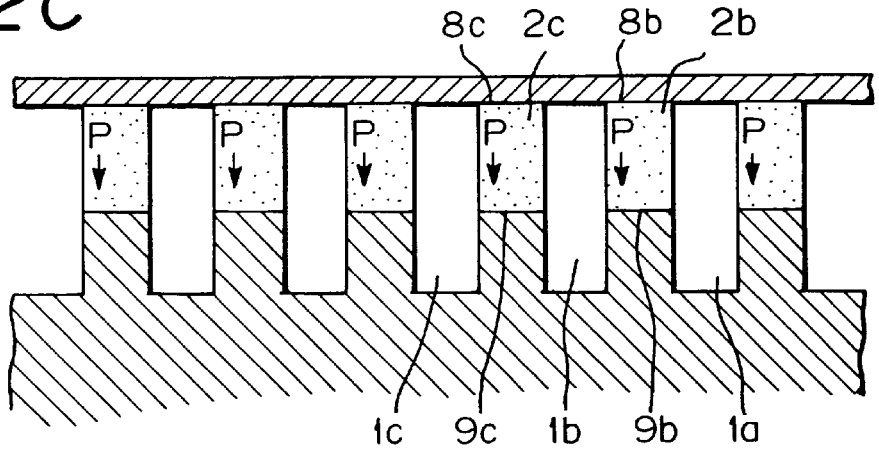

The operation of the illustrative embodiment will be described with reference to FIGS. 2A–2C which are sections along line A–A' shown in FIG. 1. Assume that the pressure chamber 1*b* is driven to eject the ink via the associated nozzle 6*b*, not shown, by way of example. To drive the pressure chamber 1*b* means to drive the piezoelectric side walls 2*b* and 2*c* delimiting it. A voltage is applied to the side walls 2*b* and 2*c* via the electrodes 8*b* and 9*b* and electrodes 8*c* and 9*c*, respectively. The voltage forms an electric field in a direction indicated by an arrow E in FIG. 2B. Because the direction E of the electric field is coincident with the direction of the polarization (direction P), the side walls 2*b* and 2*c* expand in the direction E while contracting in the direction perpendicular to the direction E, as shown in FIG. 2B. As a result, the volume of the chamber 1*b* increases and thereby lowers the pressure in the chamber 1*b*. Therefore, the ink is fed from the ink pool 7 into the chamber 1*b* in the same amount as the increase in the volume of the chamber 1*b*. Subsequently, the voltage is interrupted to cause the electric field to disappear. Consequently, as shown in FIG. 2C, the side walls 2*b* and 2*c* restore their original positions and again reduce the volume of the chamber 1*b*. This compresses the ink in the chamber lb and ejects it via the nozzle 6*b*. Such an operation is repeated at a preselected position at a print timing with the print head shown in FIG. 1 being sequentially moved relative to a sheet, not shown. As a result, a text image or a graphic image is printed on the sheet in the form of ink dots.

Figure 3:
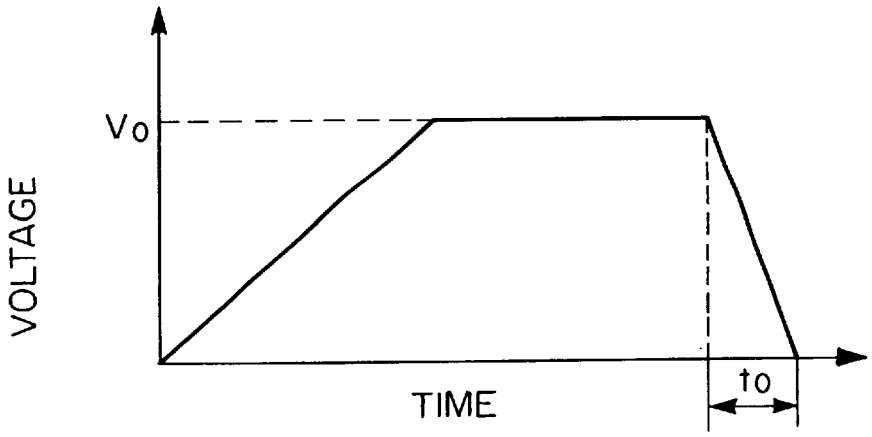
FIG. 3 shows the waveform of a drive voltage.
Figure 4:
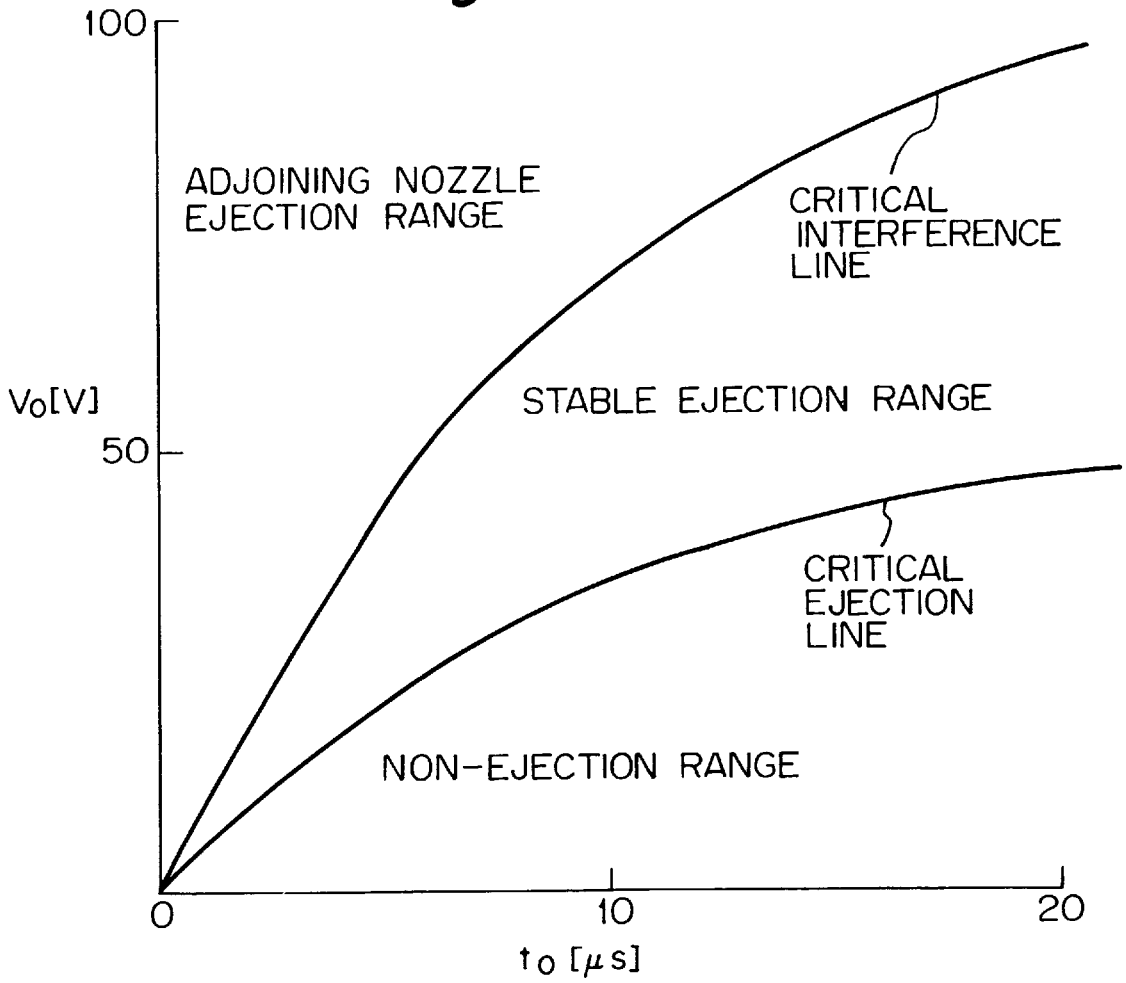
FIG. 4 shows driving conditions.

Conditions for driving the device shown in FIG. 1 will be described on the basis of the results of experiments. FIG. 3 shows the waveform of a drive voltage. As shown, the drive voltage applied to the side walls surrounding the the pressure chamber to be driven is elevated to $V_0$ at a preselected rate, then held at $V_0$ for a preselected period of time, and then lowered to 0 V in a period of time to. FIG. 4 shows the results of experiments obtained when the period of time to and voltage $V_0$ were changed. When the voltage $V_0$ was sequentially increased with the period of time $t_0$ maintained constant, no ink drops were ejected so long as the voltage $V_0$ was low. When the voltage exceeded a certain threshold $V_{th}$, ink drops began to be ejected. When the voltage $V_0$ was further increased above a certain value $V_{if}$, ink drops began to be ejected from the adjoining nozzle also. Let lines connecting the points where $V_{th}$ and $V_{if}$ are obtained by changing the period of time $t_0$ be referred to as a critical ejection line and a critical interference line, respectively. Then, the range below the critical ejection line is a non-ejection range while the range above the critical interference line is a range in which the ink is ejected even from the adjoining nozzles. Therefore, the range above the critical ejection line, but below the critical interference line, is a stable ejection range. The pressure chamber is driven in the stable ejection range. The critical interference voltage $V_{if}$ is substantially twice as high as the critical ejection voltage $V_{th}$, as determined by experiments. Therefore, the drive voltage $V_0$ is selected to be above the voltage $V_{th}$, but below the voltage double the voltage $V_{th}$.

Presumably, the non-ejection range stems from the surface tension of the ink existing in the nozzle; energy overcoming the surface tension is necessary for the ink to be ejected. Why the range in which the ink is ejected even from the adjoining nozzles is presumably as follows. Pressure inside the pressure chamber next to the driven chamber changes because one side wall thereof deforms. Such a pressure change in the next chamber is considered to be about one-half of the pressure change in the driven chamber. Presumably, when the pressure change in the next chamber is great enough to overcome the surface tension of the ink, ink drops are ejected even from the adjoining nozzle.

The above is also true when the voltage is replaced with the velocity of displacement of the piezoelectric side wall. Assume that the critical velocity of displacement at which ink drops begin to be ejected is $V_{th}$. Then, the velocity of displacement v allowing the ink drops to be stably ejected is above $v_{th}$, but below $2\times v_{th}$. The above condition may be considered in terms of energy to be applied to the pressure chamber, as follows. Assume that energy causing the ink drops to begin to be ejected is $U_{th}$. Then, energy U allowing the ink drops to be stably ejected is above $U_{th}$, but below $4\times U_{th}$. It is to be noted that the critical values $V_{th}$, $v_{th}$ and $U_{th}$ depend on the physical property of the print head and that of the ink and can be determined by experiments and/or simulation.

Figure 5:
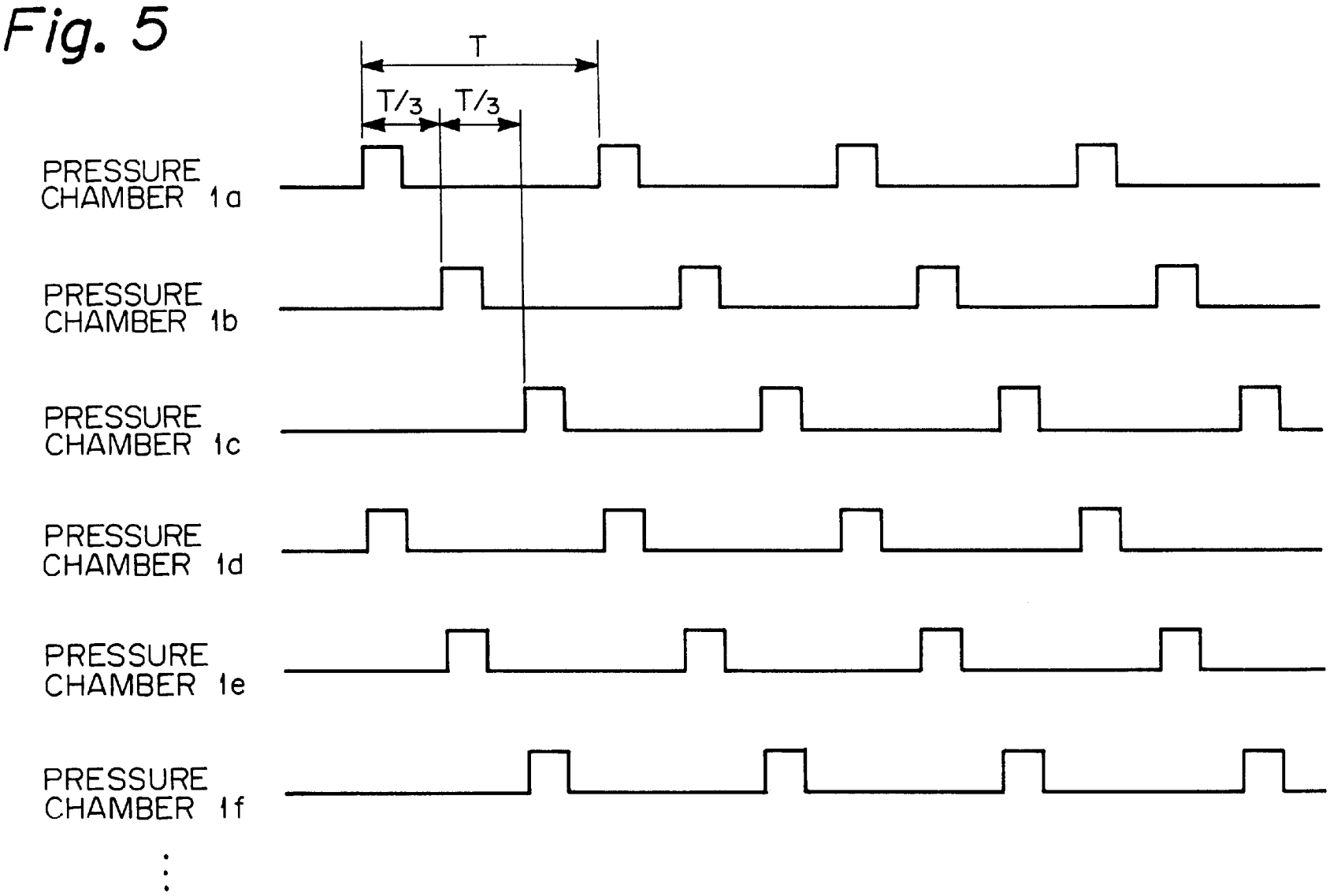
FIG. 5 is a timing chart showing a first embodiment of a method of driving a plurality of pressure chambers.

In a first embodiment of the present invention, a plurality of pressure chambers are driven so as to eject ink drops via their nozzles. FIG. 5 is a timing chart demonstrating the operation of the first embodiment. A s shown, each pressure chamber 1 is driven at a period T and at a time deviated from the next pressure chamber by T/3 or 2T/3. In FIG. 5, the pressure chambers 1*a* and 1*d* are driven at the same timing while the pressure chambers 1*b* and 1*e* are driven at the same timing. Likewise, the pressure chambers 1*c* and 1*f* are driven at the same timing. That is, every third chamber 1 is driven at the same timing. In this case, the nozzles 6 of the nozzle plate 5 are arranged, as shown in FIG. 6.

Figure 6:
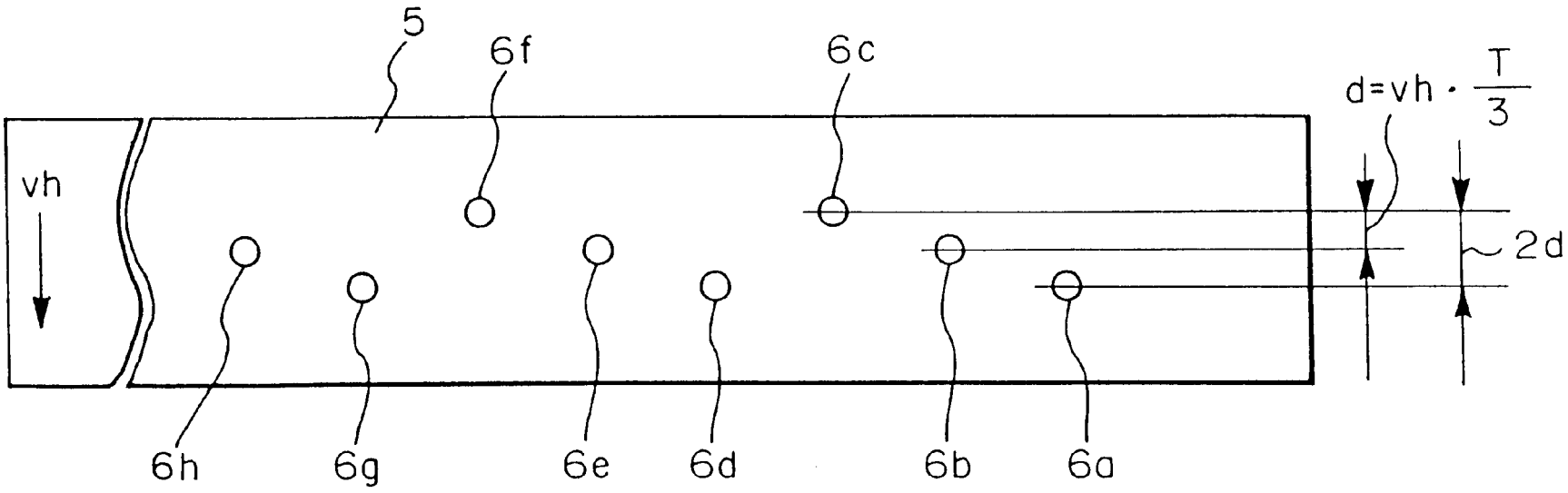
FIG. 6 shows a positional relation between nozzles included in the first embodiment.

In FIG. 6, the nozzles 6*a*, 6*b*, 6*c* and so forth are respectively communicated to the pressure chambers 1*a*, 1*b*, 1*c* and so forth. Assume that the print head moves at a velocity of $v_h$ in the direction indicated by an arrow relative to a sheet. Then, in FIG. 6, the nozzles 6*a*, 6*d* and 6*g* and the nozzles 6*b*, 6*e* and 6*h* are deviated from each other by $d=v_h\cdot T/3$ in the direction of velocity $v_h$. Likewise, the nozzles 6*b*, 6*e* and 6*h* and the nozzles 6*c* and 6*f* are deviated by $d=v_h\cdot T/3$ in the above direction. Every third nozzle 6 is arranged at the same level. When the pressure chambers 1 are driven at the timing shown in FIG. 5 with the print head having the nozzle arrangement of FIG. 6 being moved, ink drops can be deposited on virtual lattice points on a sheet. Use may, of course, be made of a nozzle plate having every n-th nozzle (n being 3 or greater natural number) arranged at the same level, in which case every n-th pressure chamber will be driven at the same timing.

Figure 7:
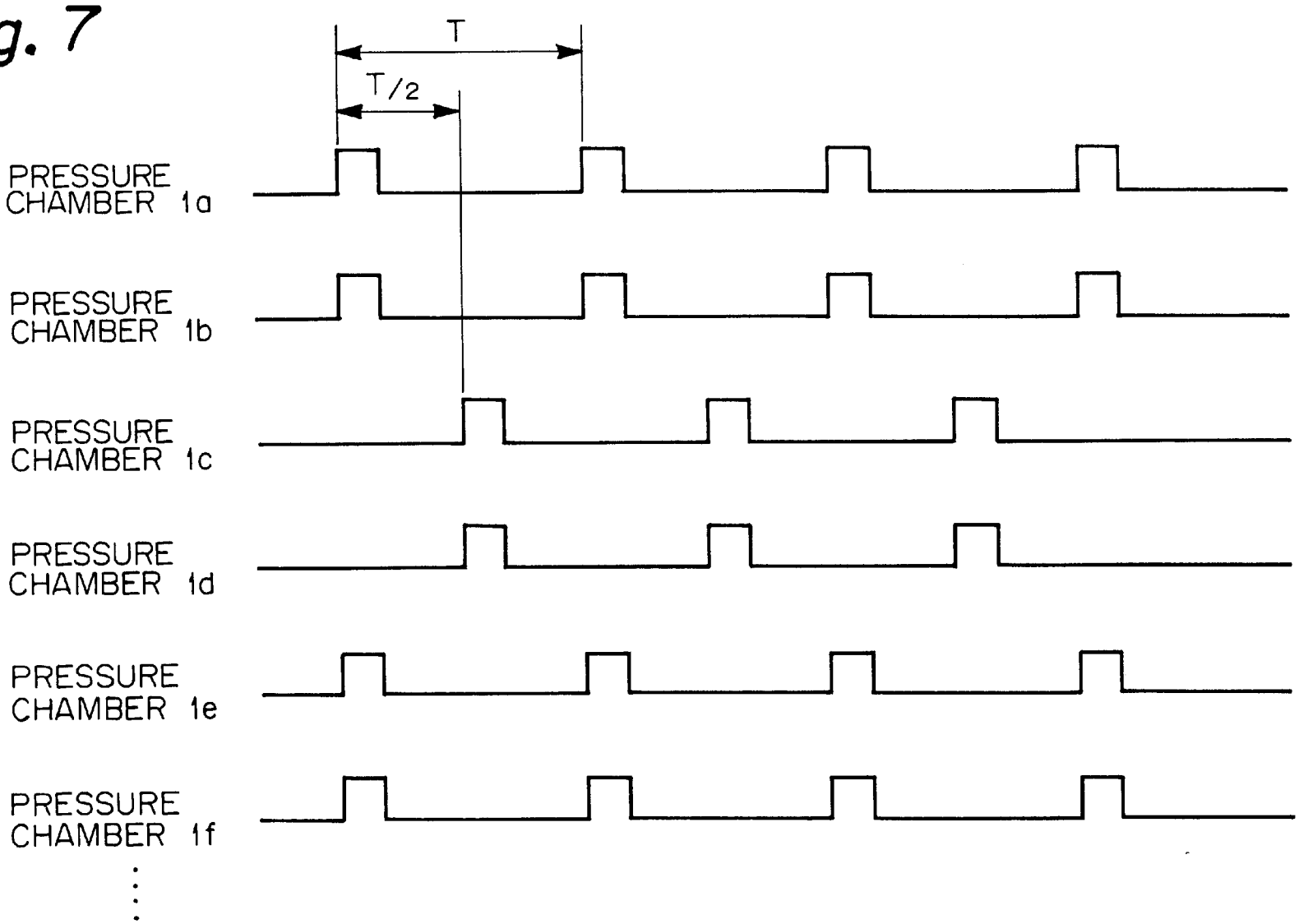
FIG. 7 is a timing chart showing a second embodiment of the present invention.
Figure 8:
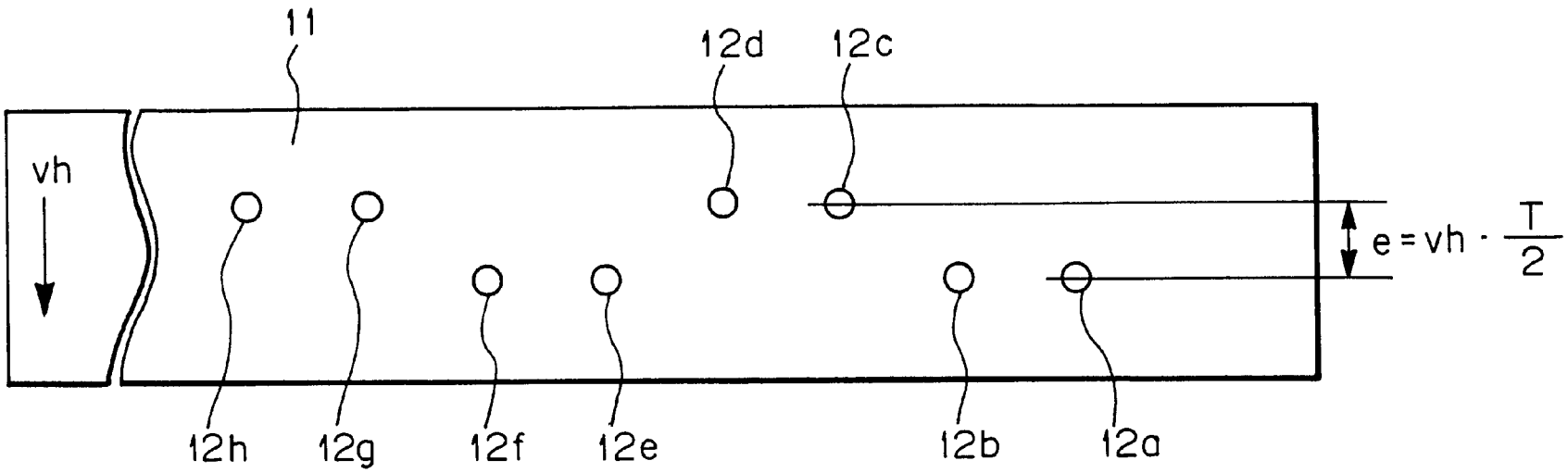
FIG. 8 shows a positional relation between nozzles particular to the second embodiment.

A second embodiment of the present invention also drives a plurality of pressure chambers so as to eject ink drops via their nozzles. This embodiment differs from the first embodiment as to the drive timing and the positional relation between the nozzles formed in the nozzle plate. As shown in FIG. 7, the pressure chambers 1 are driven at a period T. In FIG. 7, the chambers 1*a*, 1*b*, 1*e* and 1*f* are driven at the same timing while the chambers 1*c* and 1*d* are driven at the same timing. The chambers 1*c* and 1*d* and the chambers 1*a*, 1*b*, 1*e* and 1*f* are deviated in timing by T/2 from each other. The crux is that each two nearby chambers 1 are driven at the same timing as each two nearby chambers 1 spaced therefrom by two pressure chambers 1. FIG. 8 shows the arrangement of nozzles 12 for practicing the above drive scheme.

As shown in FIG. 8, nozzles 12*a*, 12*b*, 12*c* and so forth are formed in a nozzle plate 11 and respectively communicated to the pressure chambers 1*a*, 1*b*, 1*c* and so forth. Assume that the print head moves at a rate vh in a direction indicated by an arrow in FIG. 8. Then, the nozzles 12*a*, 12*b*, 12*e* and 12*f* and the nozzles 12*c*, 12*d*, 12*g* and 12*h* are deviated from each other by $e=v_h\cdot T/2$ in the above direction. Each two nearby nozzles are positioned at the same level as each two nearby nozzles spaced therefrom by two nozzles. When the pressure chambers 1 are driven at the timing shown in FIG. 7 with the print head having the nozzle arrangement of FIG. 8 being moved, ink drops can be deposited on the virtual lattice points on a sheet. Use may, of course, be made of a nozzle plate having every n-th nozzle (n being 3 or greater natural number) arranged at the same level, in which case every n-th pressure chambers will be driven at the same timing.

Figure 9:
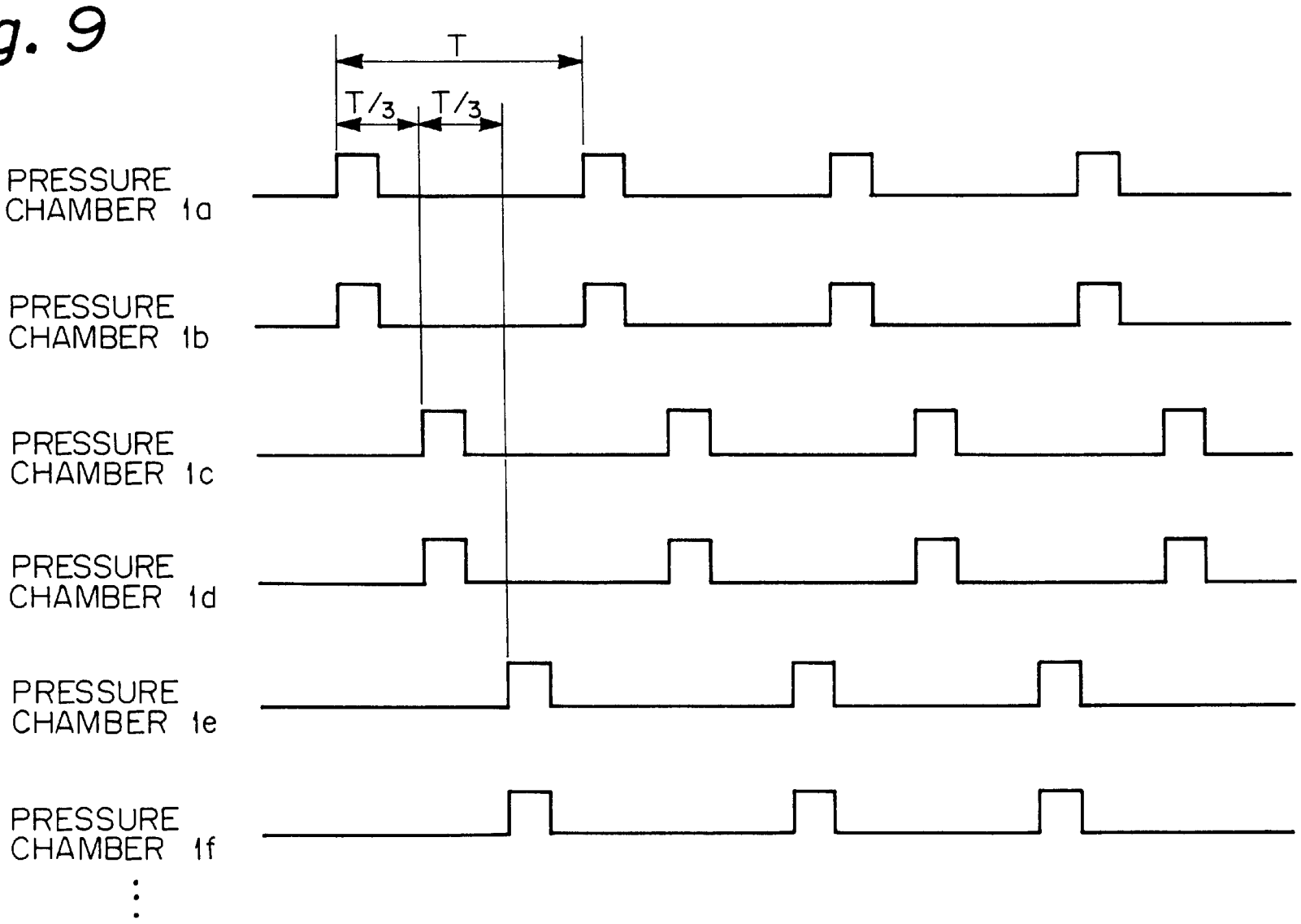
FIG. 9 is a timing chart showing a third embodiment of the present invention.
Figure 10:
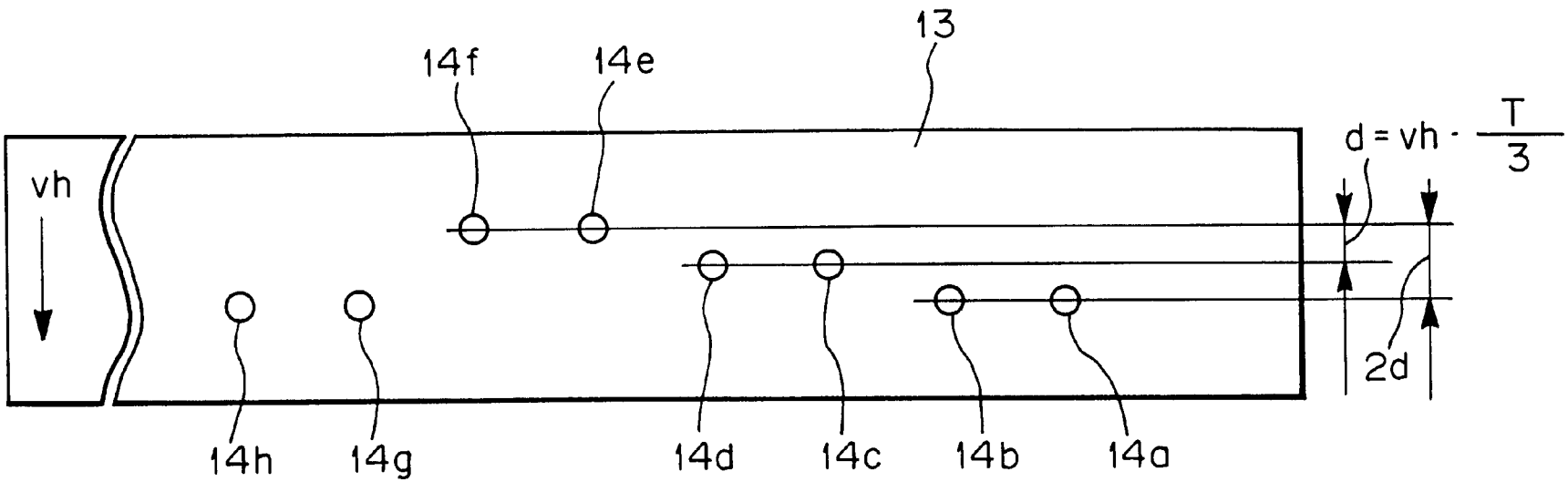
FIG. 10 shows a positional relation between nozzles particular to he third embodiment.

A third embodiment of the present invention also drives a plurality of pressure chambers so as to eject ink drops via their nozzles. This embodiment differs from the first and second embodiments as to the drive timing and the positional relation between the nozzles formed in the nozzle plate. As shown in FIG. 9, the pressure chambers 1 are driven at a period T. In FIG. 9, the pressure chambers 1*a* and 1*b* at driven at the same timing while the pressure chambers 1*c* and 1*d* are driven at the same time. Also, the pressure chambers 1*e* and If are driven at the same timing. The chambers 1*a* and 1*b* and the chambers 1*c* and 1*d* are deviated from each other by T/3. Likewise, the chambers 1*c* and 1*d* and the chambers 1*e* and 1*f* are deviated from each other by T/3. Each two nearby chambers 1 are driven at the same timing as each two chambers 1 spaced therefrom by four chambers 1. FIG. 10 shows nozzles formed in a nozzle plate 13 for practicing t he above drive scheme.

As shown in FIG. 10, nozzles 14*a*, 14*b*, 14*c* and so forth formed in the nozzle plate 13 and respectively communicated to the pressure chambers 1*a*, 1*b*, 1*c* and so forth. Assume that the print head moves at a velocity vh in a direction indicated by an arrow in FIG. 10. Then, the nozzles 14*a*, 14*b*, 14*g* and 14*h* and the nozzles 14*c* and 14*d* are deviated from each other by $d=v_h\cdot T/3$ in the above direction. Likewise, the nozzles 14*c* and 14*d* and the nozzles 14*e* and 14*f* are deviated from each other by $d=v_h\cdot T/3$. Each two nearby nozzles are positioned at the same as each two nozzles spaced therefrom by four nozzles. When the pressure chambers 1 are driven at the timing shown in FIG. 9 with the print head having the nozzle arrangement of FIG. 10 being moved, ink drops can be deposited on the virtual lattice points on a sheet. Use may, of course, be made of a nozzle plate having every n-th nozzle (n being 3 or greater natural number) arranged at the same level, in which case every n-th pressure chamber will be driven at the same timing.

While the illustrative embodiments each has a particular drive timing and a particular nozzle arrangement, in practice the individual pressure chamber is selectively driven in response to a print command. Therefore, in each timing chart shown and described, each high level is sometimes replaced with a low level. Of course, the rectangular waves shown in the timing charts may be replaced with triangular waves, trapezoidal waves, saw-toothed waves or any other suitable waves. In addition, either of the positive logic or the negative logic may be used, as desired.

Hereinafter will be described a control system for controlling the ink jet recording device of the present invention.

Figure 11:
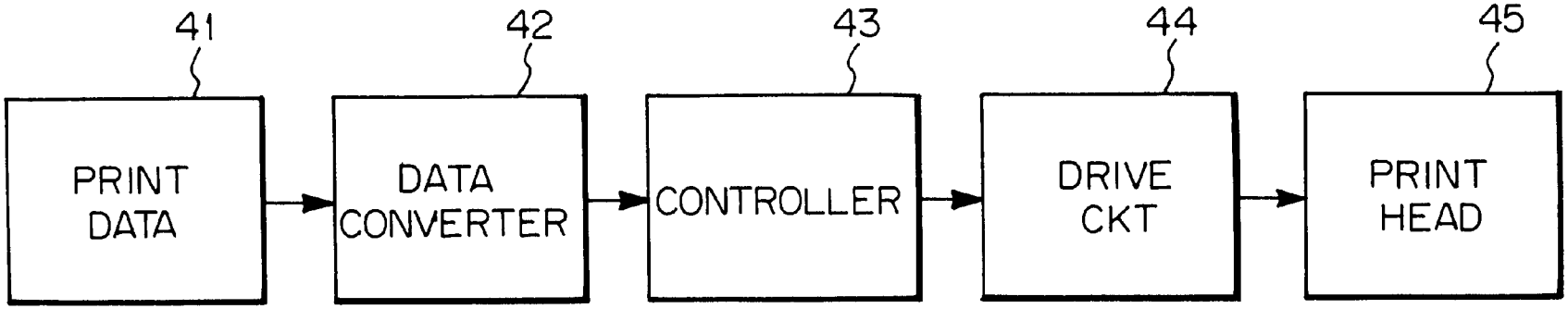
FIG. 11 is a block diagram schematically showing a specific control system applicable to the device of the present invention.

In accordance with the present invention, to cause an ink drop to be ejected from a certain nozzle, two piezoelectric elements (side walls) defining the pressure chamber communicated to the nozzle are driven, as stated earlier. FIG. 11 schematically shows a specific control system. As shown, print data 41 indicating whether or not to eject an ink drop from the individual nozzle or representative of information including an amount of ink drop are fed to a data converter 42. The data converter 42 transforms the nozzle-by-nozzle information to data meant for two piezoelectric elements constituting the individual chamber. Let the nozzles and piezoelectric elements each be provided with serial numbers beginning with 1 (one). Then, when an ink drop is to be ejected from the nozzle #i, the data converter 42 transforms the input information to data for driving the piezoelectric elements #i and #i+1. The data output from the data converter 42 are fed to a controller 43. The controller 43 performs, e.g., pulse width modulation in accordance with the element-by-element data, e.g., amount of an ink drop to be ejected. The resulting print data output form the controller 43 are delivered to a driver 44. In response, the driver 44 selectively feeds power to the individual piezoelectric elements of a print head 45 in accordance with the print data.

Figure 12:
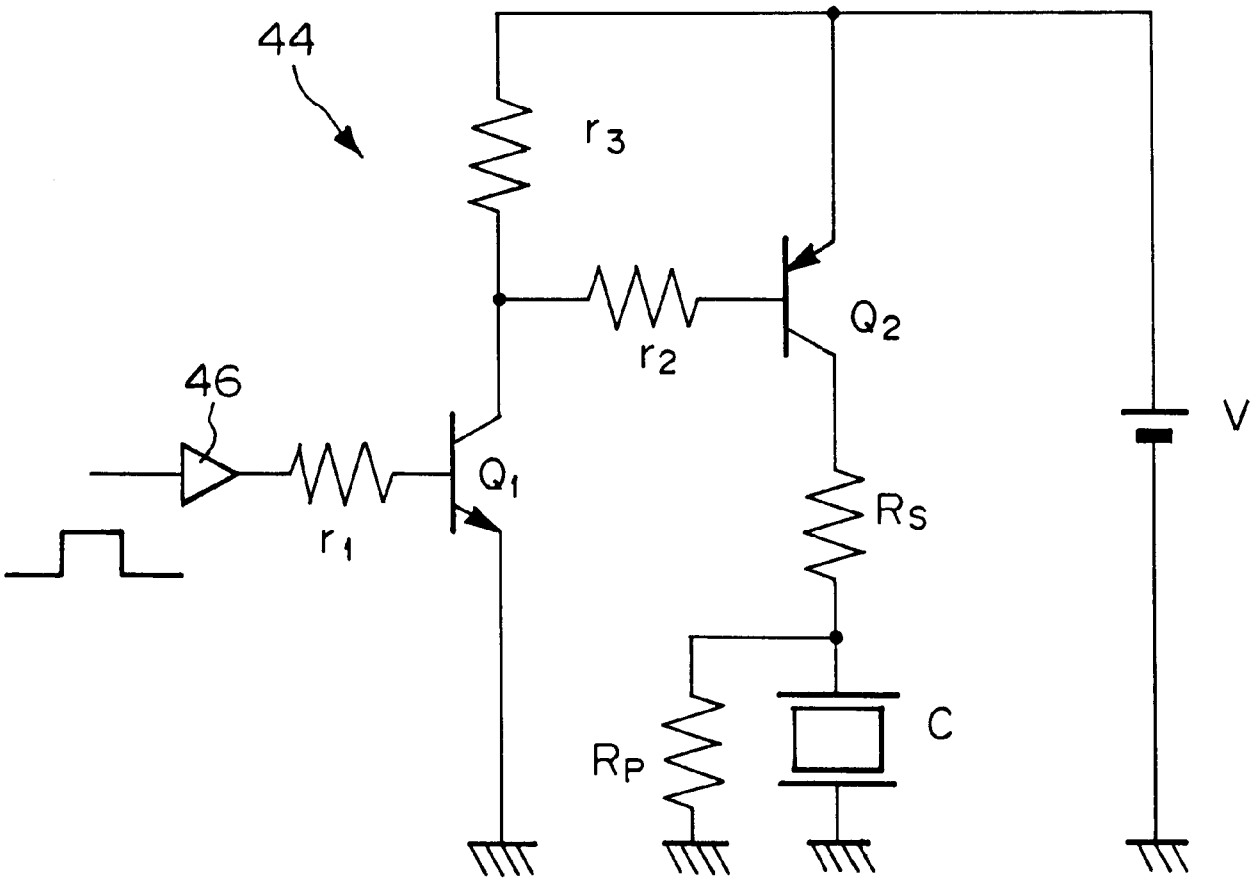
FIG. 12 is a circuit diagram showing a specific arrangement of a driver included in the system of FIG. 11.

FIG. 12 shows a specific configuration of a circuit included in the driver 44 and assigned to one of the piezoelectric elements. The driver 44 is an assembly of such circuits identical in number as the piezoelectric elements. All the circuits of the driver 44 may share a single power source V. At the time of printing, a print signal output from the controller 43 is input to a buffer 46. In response, an n-p-n transistor Q1 causes its base voltage to go high with the result that a base current flows and renders the transistor Q1 conductive. This causes the base voltage of a p-n-p transistor Q2 to go low and causes a base current to flow therethrough. As a result, the transistor Q2 turns on. Consequently a current flows from the power source V to a piezoelectric element C via the transistor Q2 and a serial resistor Rs, raising the voltage of the element C and thereby causing the element C to expand.

Subsequently, when the print signal output from the controller 43 goes low, the base voltage of the transistor Q1 goes low and shuts off the base current, thereby rendering the transistor Q1 nonconductive. In response, the base voltage of the transistor Q2 goes high and shuts off the base current, thereby turning off the transistor Q2. As a result, the charge stored in the piezoelectric element C is discharged via a parallel resistor Rp parallel to the element C. The resulting fall of the voltage of the element C causes the element to restore its original position. Consequently, the element C compresses the ink in the pressure chamber and thereby ejects an ink drop. The driver 44 is therefore a CR charge/discharge circuit which charges the element via the resistor Rs and discharges it via the resistor Rp.

It has been customary with a drive circuit for the above application to use an exclusive transistor or similar switching device for each of charging and discharging. The driver of the present invention is simple and inexpensive because it does not need a switching element for discharging.

While in FIG. 12 the switching device is implemented as a bipolar transistor, it may be replaced with an FET (Field Effect Transistor), thyristor or any other suitable switching device. The serial resistor Rs and parallel resistor Rp each plays the role of resistance generating means. If desired, such resistance generating means may be implemented by the inside resistance between the power source and the piezoelectric element or the inside resistance of the piezoelectric element itself.

In accordance with the present invention, the diameter of a dot to be printed on a sheet is variable, as follows. To change the dot diameter, the amount of an ink drop to be ejected may be changed. This can be done with the circuit of FIG. 12 if the pulse width of the print signal is varied within a range smaller than the time constant assigned to charging. That is, the pulse width is reduced to eject a small drop or increased to eject a large drop. Specifically, when the pulse width is small, the voltage and therefore the displacement of the piezoelectric element is reduced to, in turn, reduce the variation of the volume of the pressure chamber, so that the amount of a drop is reduced. When the pulse width is great, the amount of a drop is increased.

Figure 13:
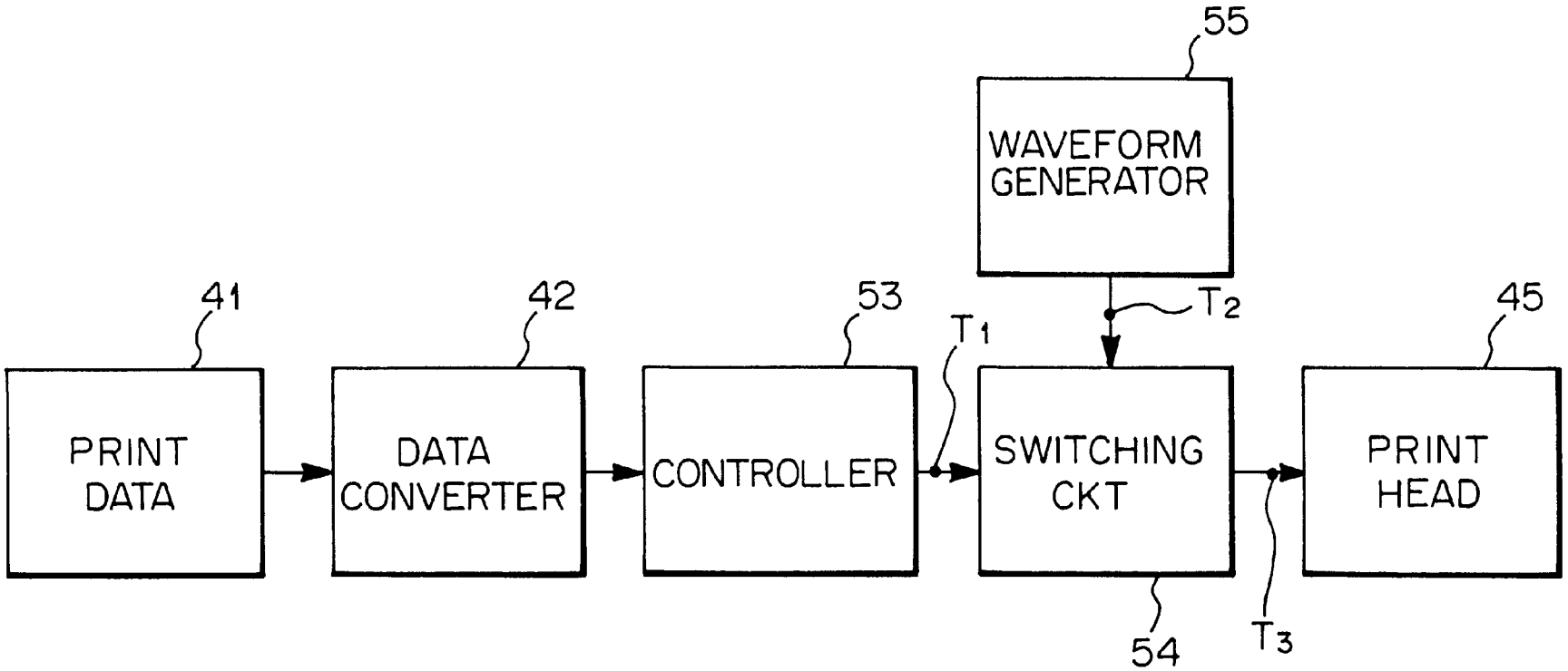
FIG. 13 is a block diagram schematically showing another specific control system.
Figure 14A:
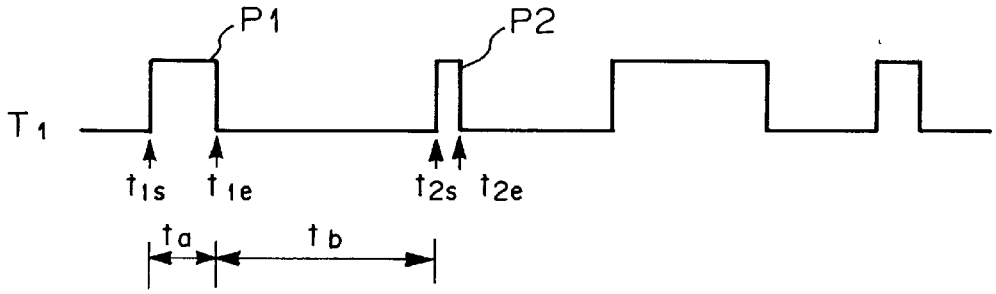
FIG. 14 shows a method of varying the amount of an ink drop to be ejected.

FIG. 13 shows another specific control system capable of controlling the amount of an ink drop. The operation of this control system will be described with reference also made to voltage waveforms shown in FIG. 14. As shown, the print data 41 indicative of an amount of an ink drop nozzle by nozzle are input to the data converter 42. The data converter 42 transforms the nozzle-by-nozzle data to data meant for each two piezoelectric elements forming a pressure chamber. Again, let the nozzles and piezoelectric elements each be provided with serial numbers beginning with 1. Then, when an ink drop is to be ejected from the nozzle #i, the data converter 42 transforms the input information to data for driving the piezoelectric elements #i and #i+1.

The data output from the data converter 42 are input to a controller 53. In response, as represented by a waveform T, in FIG. 14(A), the controller 53 generates a first pulse P1 and a second pulse P2 for a single print timing. The first pulse P1 goes high at a time $t_{1s}$ and goes low at a time $t_1e$ while the second pulse P2 goes high at a time $t_{2s}$ and goes now at a time $t_{1e}$. The times $t_{1s}$ and $t_2e$ are constant for a single print timing. The times $t_1e$ and $t_{2s}$, i.e., the interval $t_b$ between the two pulses P1 and P2 ($t_b=t_{2s}-t_{1e}$) is varied in accordance with the amount of an ink drop. This successfully controls the amount of an ink drop to be ejected.

Figure 14B:
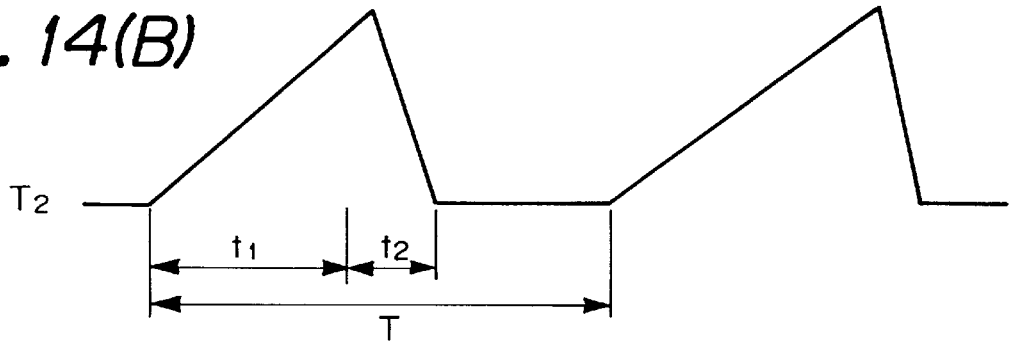

As represented by a waveform $T_2$ in FIG. 14(B), a waveform generator 55 generates a voltage waveform resembling a saw-toothed wave at a preselected period T. The waveform $T_2$ includes a rising portion and a falling portion. The waveform $T_2$ is input to a switching circuit 54. The switching circuit 54 turns on and turns off the output voltage of the waveform generator 55 on receiving the control pulse T1 from the controller 53. As a result, the output voltage of the waveform generator 55 is continuously applied to the piezoelectric element of the print head 45 while the first and second pulses P1 and P2 are in their high levels. Because the piezoelectric element is a capacity element, the voltage applied at the time $t_1e$ is substantially maintained even during the interval between the times $t_1e$ and $t_{2s}$, although some voltage drop occurs due to natural discharge. The time $t_{2s}$ when the pulse P2 goes high is unconditionally determined by the voltage waveform output from the waveform generator 55 and the time $t_1e$ at which the pulse P1 ends. Stated another way, at the time $t_{2s}$, the voltage output from the waveform generator 55 falls to a voltage equal to the voltage at the time $t_{1e}$. Assuming that the saw-tooth wave rises over a period of time of $t_1$ and falls over a period of time of $t_2$, then the interval $t_b$ between the pulses P1 and P2 is expressed as:

$$t_b=t_1+t_2-(1+t_2/t_1)\times ta \qquad \text{Eq. (1)}$$

Figure 14C:
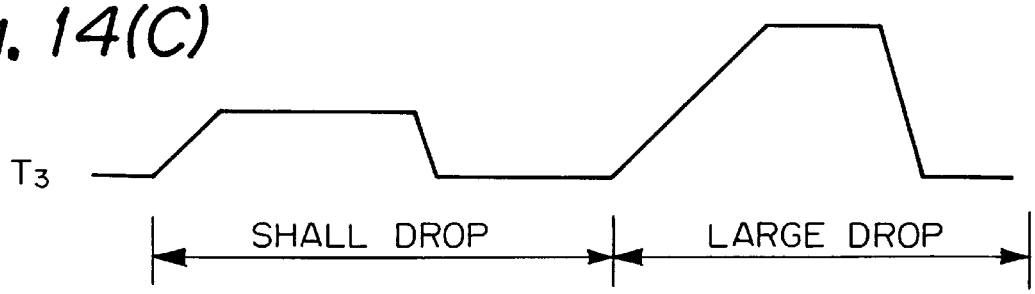

Consequently, the voltage applied to the piezoelectric element of the print head 45 has a waveform $T_3$ shown in FIG. 14(C). To change the amount of an ink drop, an arrangement is made such that the pulse width ta of the pulse P1 is varied while the interval $t_b$ between the pulses P1 and P2 is determined by the pulse width $t_a$. To eject a large ink drop, the pulse with $t_a$ is increased. As a result, the waveform $T_3$ rises and falls as represented by the second high voltage, so that a high voltage is applied to the piezoelectric element to form a large ink drop.

With the above arrangement, it is possible to change the voltage while maintaining its rate of fall constant, i.e., to change the displacement of the piezoelectric element while maintaining its rate constant. Consequently, the amount of an ink drop can be changed without changing the velocity of the ink drop.

Figure 15:
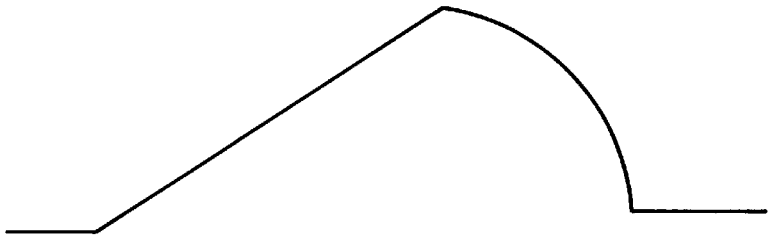
FIG. 15 shows a waveform output from a waveform generator included in the system of FIG. 13.

It may occur that the velocity of an ink drop is not constant, depending on the structure and configuration of the print head and the property of the ink. In such a case, the waveform output from the waveform generator 55 may be modified, as shown in FIG. 15 by way of example. With the waveform of FIG. 15, it is possible to vary the amount of an ink drop while maintaining the velocity thereof constant. Again, the voltage of the waveform generator 55 drops, at the time $t_{2s}$, to a voltage equal to the voltage at the time $t_{1e}$. In this manner, by matching the output waveform of the waveform generator 55 to the characteristic of the print head, the control system readily controls the amount of an ink drop while maintaining the ejection velocity constant.

Figure 16:
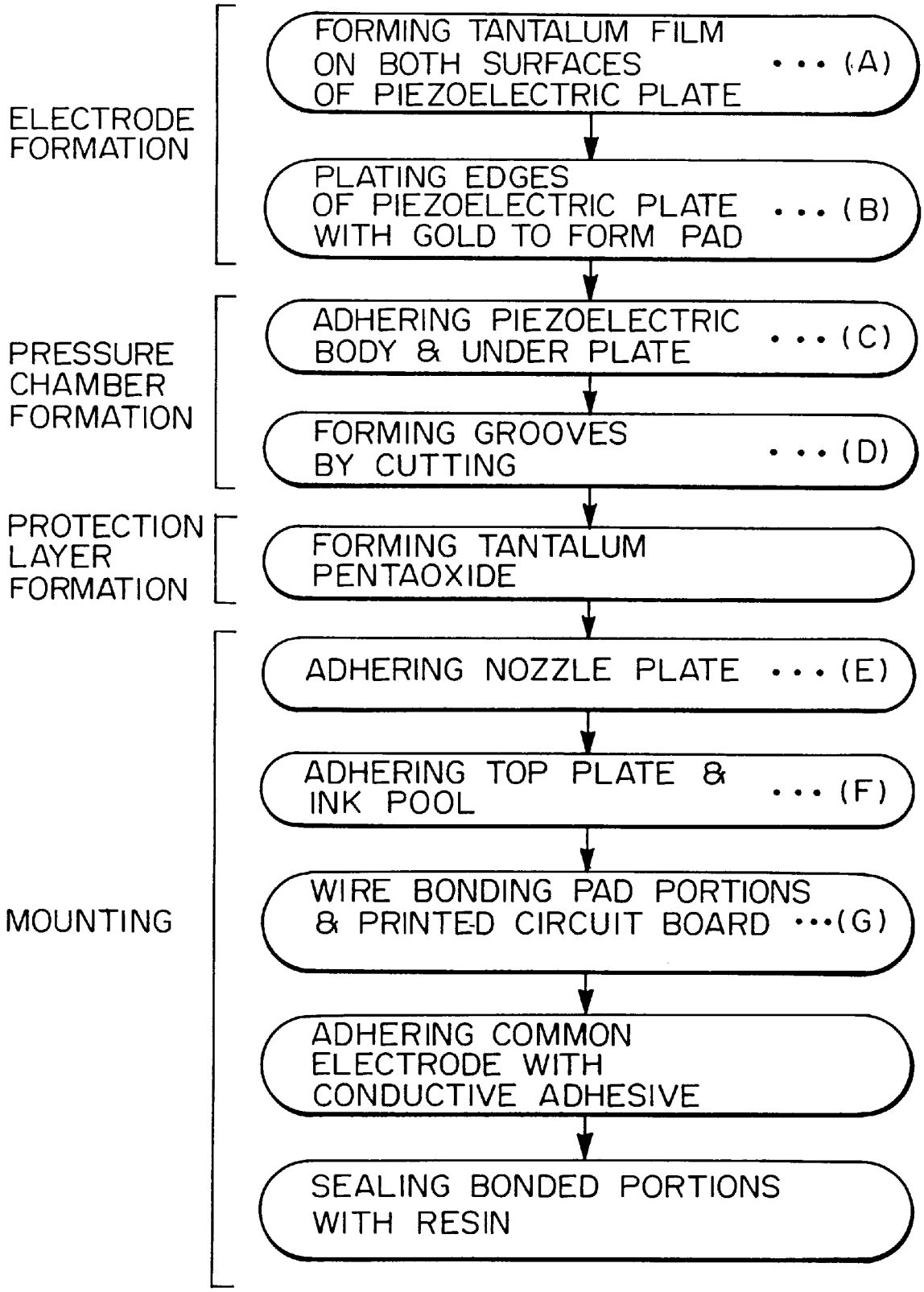
FIGS. 16 and 17 show a first embodiment of a print head included in the device of the present invention.
Figure 17A:
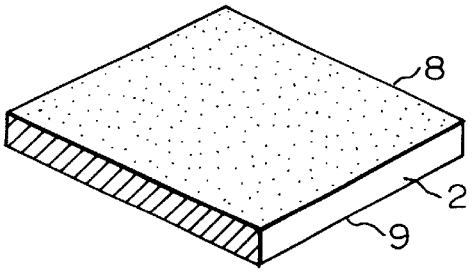
Figure 17B:
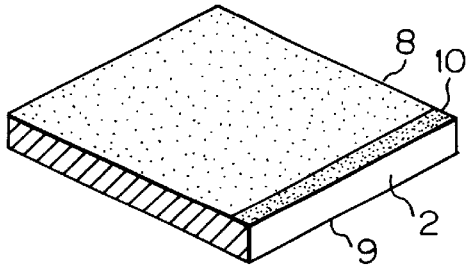
Figure 17C:
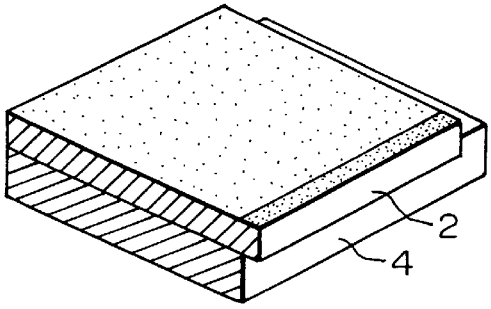
Figure 17D:
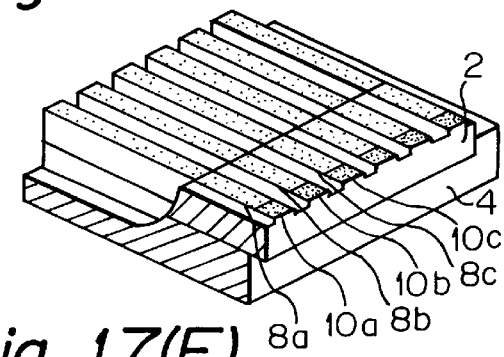
Figure 17E:
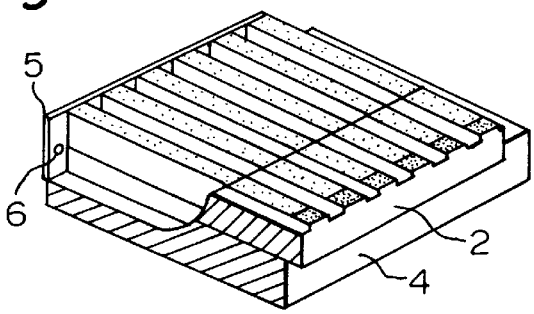
Figure 17F:
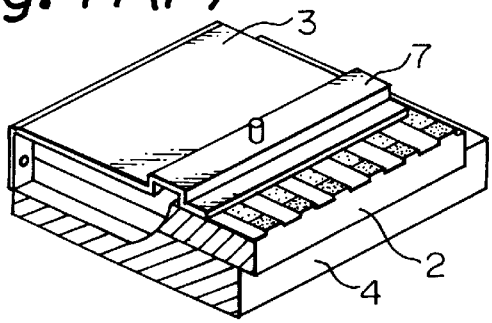
Figure 17G:
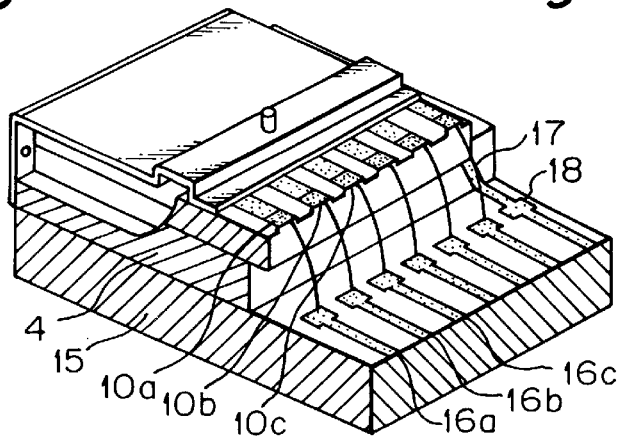
Figure 17H:
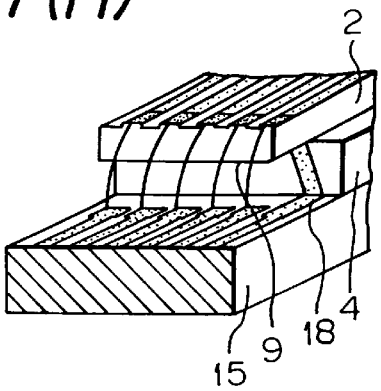
Figure 18A:
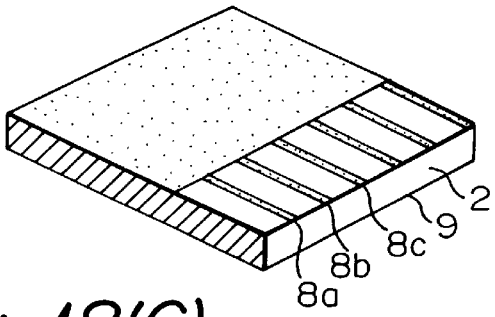
FIGS. 18, 19 and 20 are fragmentary sectional perspective views showing a second, a third and a fourth embodiment of the print head included in the device of the present invention.
Figure 18B:
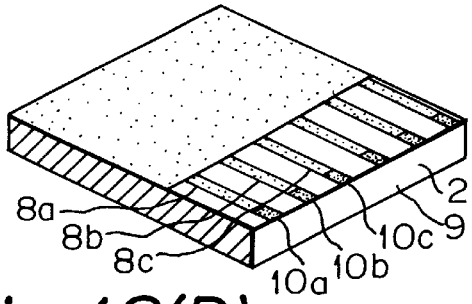
Figure 18C:
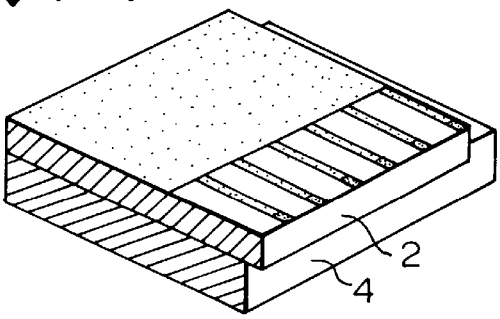
Figure 18D:
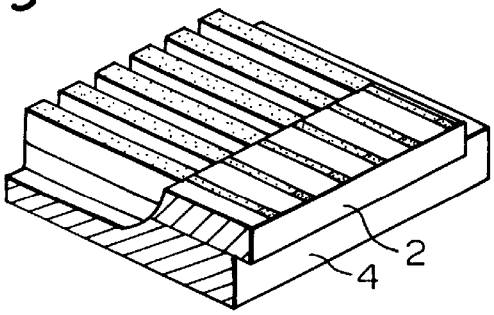
Figure 18E:
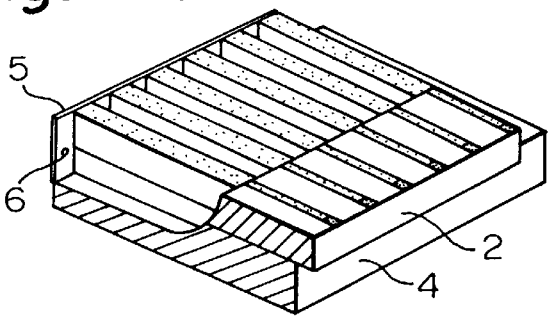
Figure 18F:
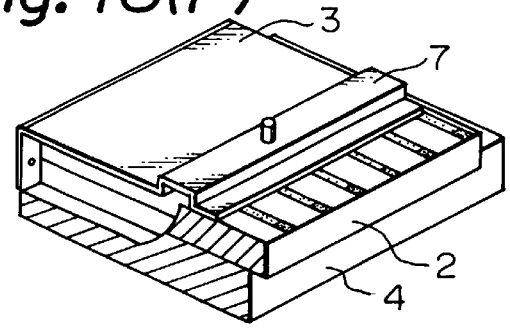
Figure 18G:
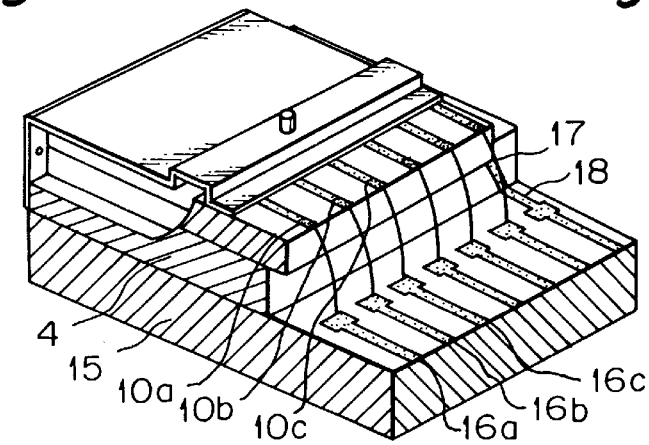
Figure 18H:
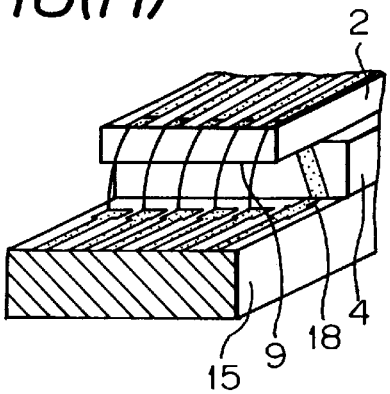
Figure 19A:
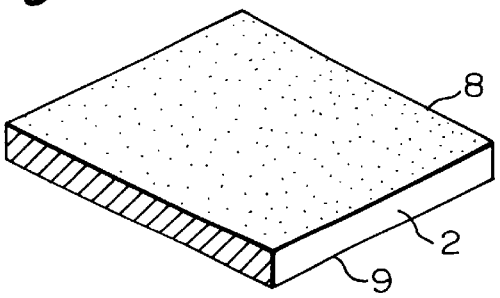
Figure 19B:
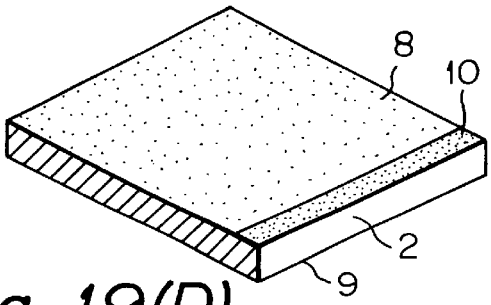
Figure 19C:
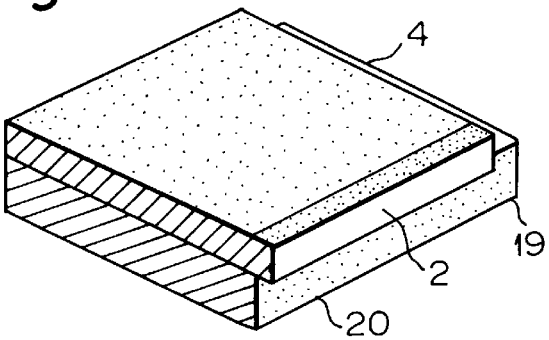
Figure 19D:
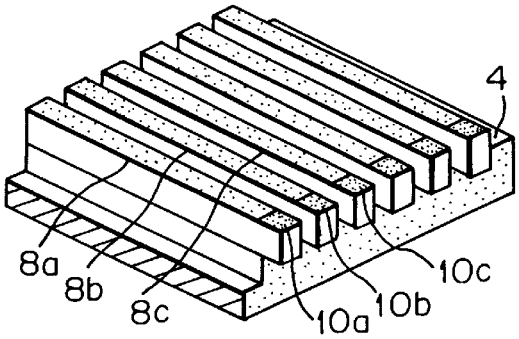
Figure 19E:
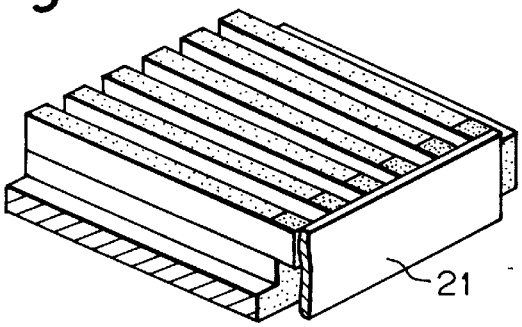
Figure 19F:
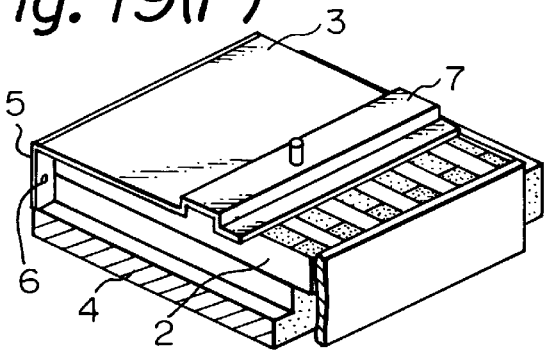
Figure 19G:
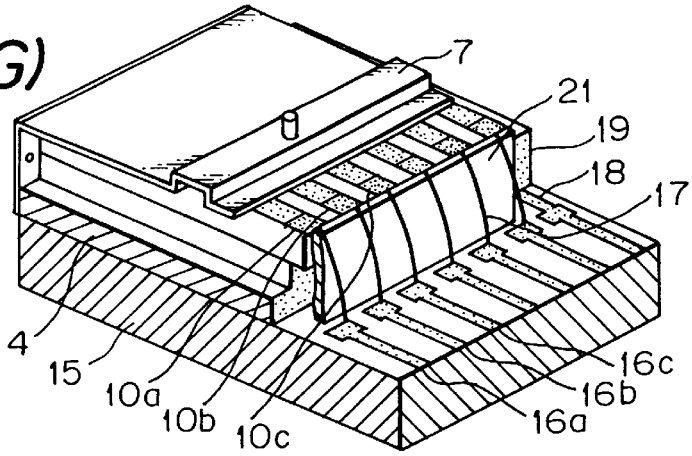
Figure 20A:
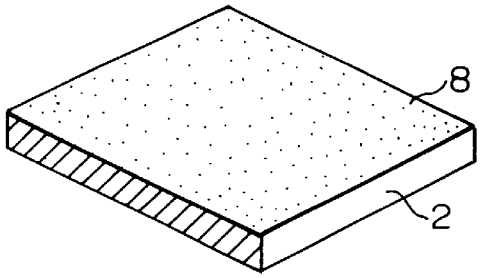
Figure 20B:
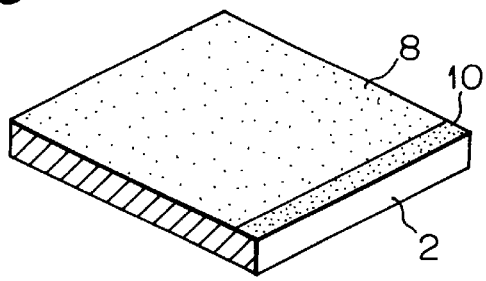
Figure 20C:
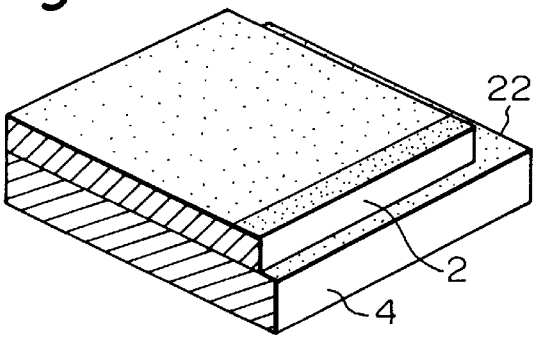
Figure 20D:
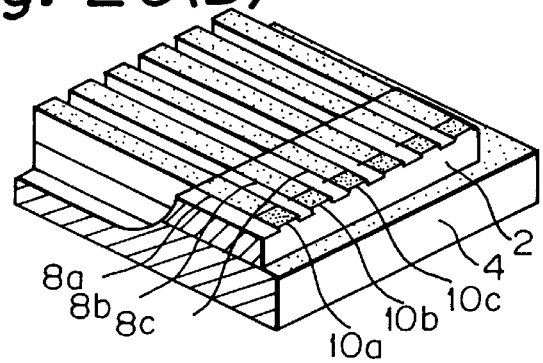
Figure 20E:
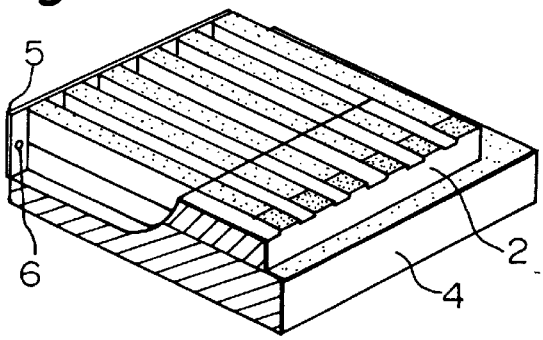
Figure 20F:
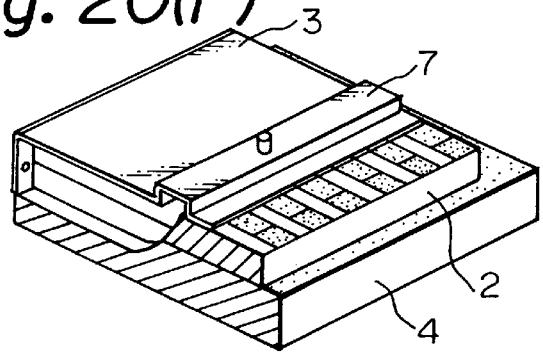
Figure 20G:
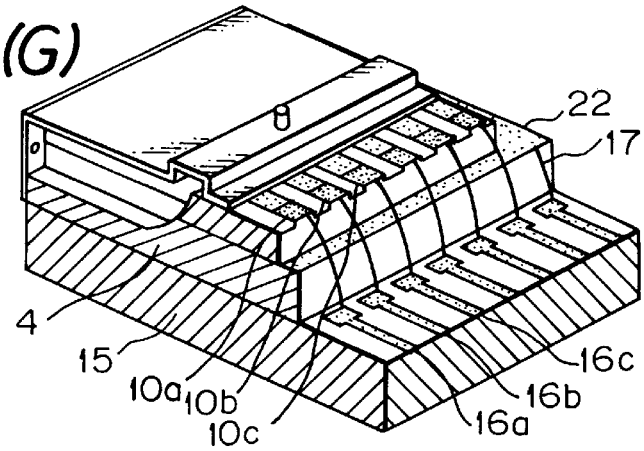

A reference will be made to FIGS. 16 and 17 for describing a specific procedure for producing the ink jet recording device shown in FIG. 1. As shown in FIG. 16, the procedure is generally made up of the formation of electrodes, the formation of pressure chambers, the formation of a protection layer, and mounting.

First, the formation of electrodes begins with a step (A) shown in FIG. 17. In the step (A), a 100 μm thick piezoelectric plate 2 is prepared which is formed of tricomponent type soft ceramics produced by adding a perovskite type composite oxide to PZT. 0.5 μm thick films of tantalum are formed on opposite major surfaces of the piezoelectric plate 2 by sputtering in order to form the electrode 8 and and electrode 9. Subsequently, in a step (B), a pad 10 is formed on the edges of the upper surface of the plate 2 by plating them with gold.

To form the pressure chambers, in a step (C) shown in FIG. 17, a 300 μm thick under plate 4 formed of the same material as the piezoelectric plate 2 is affixed to the plate 2 by adhesive based on epoxy resin. Then, in a step (D), a plurality of grooves each being 63.5 μm wide are formed by cutting at a pitch of 127 μm. Each groove consists of a first portion as deep as 200 μm for playing the role of a pressure chamber, and a second portion as shallow as 10 μm. This shallow portion separates the electrode 8 and pad 10 in order to form the electrode 8*a*, 8*b*, 8*c* and so forth and pad portion 10*a*, 10*b*, 10*c* and so forth. The underside of the piezoelectric plate 2 constitutes the common electrode 9.

To form a protection layer, the above laminate is immersed in a 0.1% aqueous solution of phosphoric acid. Then, a voltage of 150 V is applied to the laminate with the electrode portions 8 and common electrode 9 serving as an anode. In this condition, the surfaces of the electrode portions 8 and the portions of the common electrode 9 exposed to the pressure chambers are subjected to anodic oxidation, so that they are covered with a 0.3 μm thick oxide film on anode of tantalum pentaoxide. At this instant, the thickness of tantalum not subjected to anodic oxidation is 0.3 μm.

The nozzle plate 5 is formed of polyimide and 80 μm thick. The nozzles 6 are formed in the nozzle plate 5 at a pitch of 127 μm by excimer laser, and each has a diameter of 40 μm. In a step (E) shown in FIG. 17, the nozzle plate 5 is adhered to the flush ends of the piezoelectric plate 2 and under plate 4 by adhesive based on epoxy resin such that the nozzles 6 respectively communicate with the grooves formed in the plates 2 and 4. Then, in a step (F), the top plate 3 and ink pool 7 are adhered to the top of the piezoelectric plate 2 by adhesive based on epoxy resin such that they cover the above grooves. The top plate 3 is formed of polyimide while the ink plate 7 is formed of PES (polyether sulphone).

Subsequently, in a step (G) shown in FIG. 17, a printed circuit board 15 is adhered to the underside of the under plate 4. Lead terminals 16*a*, 16*b*, 16*c* and so forth (collectively 16) are formed on the printed circuit board 15 for connecting the pad portions 10 and common electrode 9. The lead terminals 16 are electrically connected to a driver, not shown. The pad portions 10 and lead terminals 16 are connected together by wire bonding. For this purpose, bonding wire 17 made of gold is used. Further, in a step (H), the common electrode 9 and lead terminals 16 are connected together by conductive paste 18. The end of the ink pool 7 contacting the electrodes 8, the portions connected by bonding and the portions to which the conductive paste is applied are sealed by epoxy resin, although not shown specifically.

A second embodiment of the ink jet recording device in accordance with the present invention will be descried with reference to FIG. 18. This embodiment is identical with the first embodiment as to the basic construction, basic dimensions and operation of the print head as well as the conditions and method of driving it. As for the fabrication, this embodiment includes unique steps for the formation of electrodes and pressure chambers. The following description will concentrate on the differences between the first and second embodiments.

First, the electrodes 8 and 9 are formed on opposite major surfaces of the piezoelectric body 2, as in the first embodiment. In a step (A) shown in FIG. 18, the upper tantalum layer is etched in a preselected pattern by photolithography in order to form the electrodes 8*a*, 8*b*, 8*c* and so forth. In a step (B), the end portions of the electrodes, collectively 8, are plated with gold so as to form the pad portions 10 (10*a*, 10*b*, 10*c* and so forth). The bottom of the piezoelectric plate 2 constitutes the common electrode.

A step (C) shown in FIG. 18 is identical with the step (C) shown in FIG. 17. In a step (D), a plurality of 63.5 μm wide grooves are formed over a predetermined length at a pitch o f 127 μm. Each groove has a portion as deep as 200 μm over a preselected length. This portion plays the role of a pressure chamber. Steps (E) through (H) shown in FIG. 18 are respectively identical with the steps (E) through (H) shown in FIG. 17.

FIG. 19 shows a third embodiment of the present invention which is also identical with the first embodiment as to the basic construction, basic dimensions and operation of the print head as well as the conditions and method of driving it. This embodiment differs from the first embodiment as to the procedure for forming the pressure chambers and the mounting procedure.

First, in steps (A) and (B) shown in FIG. 19, the electrodes 8 and 9 are formed in exactly the same manner as in the first embodiment. In a step (C) for forming the pressure chambers, the under plate 4 is 300 μm thick and formed of the same material as the piezoelectric plate 2. The under plate 4 is adhered to the piezoelectric plate 2 by adhesive based on epoxy resin. In the illustrative embodiment, a 0.5 μm thick tantalum film is formed on the end of the under plate 4 by sputtering to serve as an electrode 19. The electrode 9 on the bottom of the piezoelectric body 2 and the electrode 19 are electrically connected by conductive adhesive 20. Subsequently, in a step (D) shown in FIG. 19, a plurality of grooves are formed in the piezoelectric plate 2 by cutting at a pitch of 127 μm over the entire length of the plate 2. The grooves are 63.5 μm wide and 200 μm deep each. As a result, the electrode 8 and pad 10 are separated from each other to form the electrodes 8*a*, 8*b*, 8*c* and so forth and pad portions 10*a*, 10*b*, 10*c* and so forth.

A protection layer is formed in the same manner as in the first embodiment. In a step (E) shown in FIG. 19, an end plate 21 is adhered to the laminate by adhesive based on epoxy resin in such a manner as to block the rear ends of the grooves. Subsequently, in a step (F), the 80 μm thick nozzle plate 5 formed of polyimide is adhered to the end of the under plate 4 by adhesive based on epoxy resin. The nozzles 6 are formed in the nozzle plate 5 at a pitch of 127 μm by excimer laser, and each has a diameter of 40 μm. In the above step (F), the nozzles 6 are respectively brought into communication with the grooves formed in the piezoelectric plate 2 and under plate 4. The top plate formed of polyimide and the ink pool 7 formed of PES are adhered to the top of the plate 2 by adhesive based on epoxy resin in such a manner as to cover the grooves of the plate 2.

Thereafter, in a step (G) shown in FIG. 19, the printed circuit board 15 is adhered to the bottom of the under plate 4. The circuit board 15 includes the lead terminals 16*a*, 16*b*, 16*c* and so forth for connecting the pad portions 10*a*, 10*b*, 10*c* and so forth and common electrode 19. The circuit board 15 is electrically connected to a driver, not shown. The pad portions 10*a*, 10*b*, 10*c* and so forth and lead terminals 16*a*, 16*b*, 16*c* and so forth are connected by the bonding wires 17 formed of gold. The common electrode 19 is connected to the lead terminals by the conductive paste 18. The portion of each groove extending from the end of the ink pool 7 to the end plate 21 is filled with epoxy resin, not shown. Further, the bonded portions and the portions applied with the conductive paste are sealed by epoxy resin, although not shown specifically.

Figure 21:
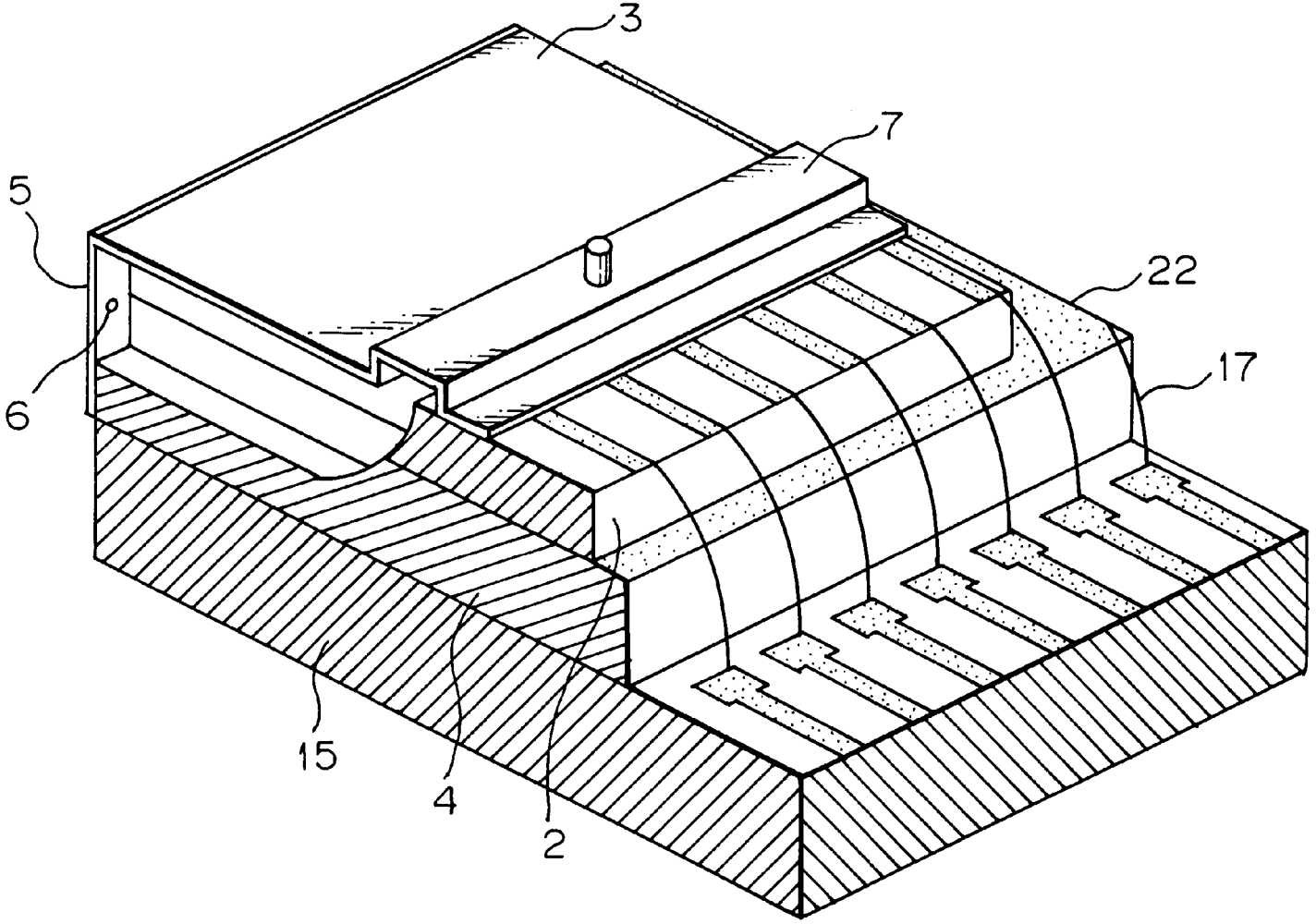
FIGS. 21 and 22 are fragmentary sectional perspective view respectively showing a fifth and a sixth embodiment of the print head included in the device of the present invention.
Figure 22:
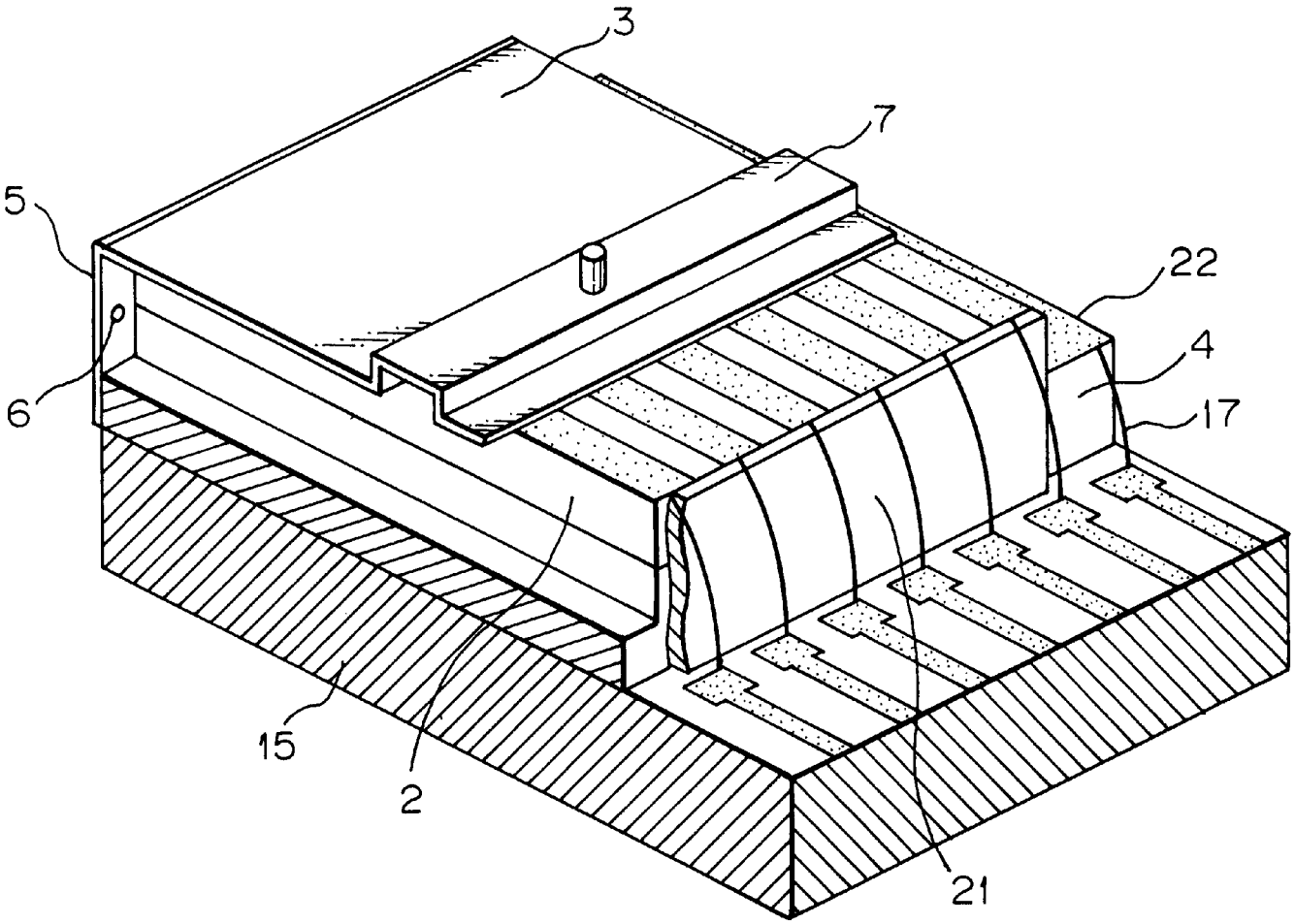

FIGS. 20, 21 and 22 respectively show a fourth, a fifth and a sixth embodiment of the present invention. These embodiments are respectively identical with the first, second and third embodiments as to the basic construction, basic dimensions and operation of the print head as well as the conditions and method for driving it. As shown in each of FIGS. 20–22, in the illustrative embodiments, the under plate 4 has a greater size than the piezoelectric plate 2. A common electrode 22 is formed on the upper surface of the under plate 4. The common electrode 22 is connected to the lead terminals of the printed circuit board 15 by wire bonding.

Figure 23:
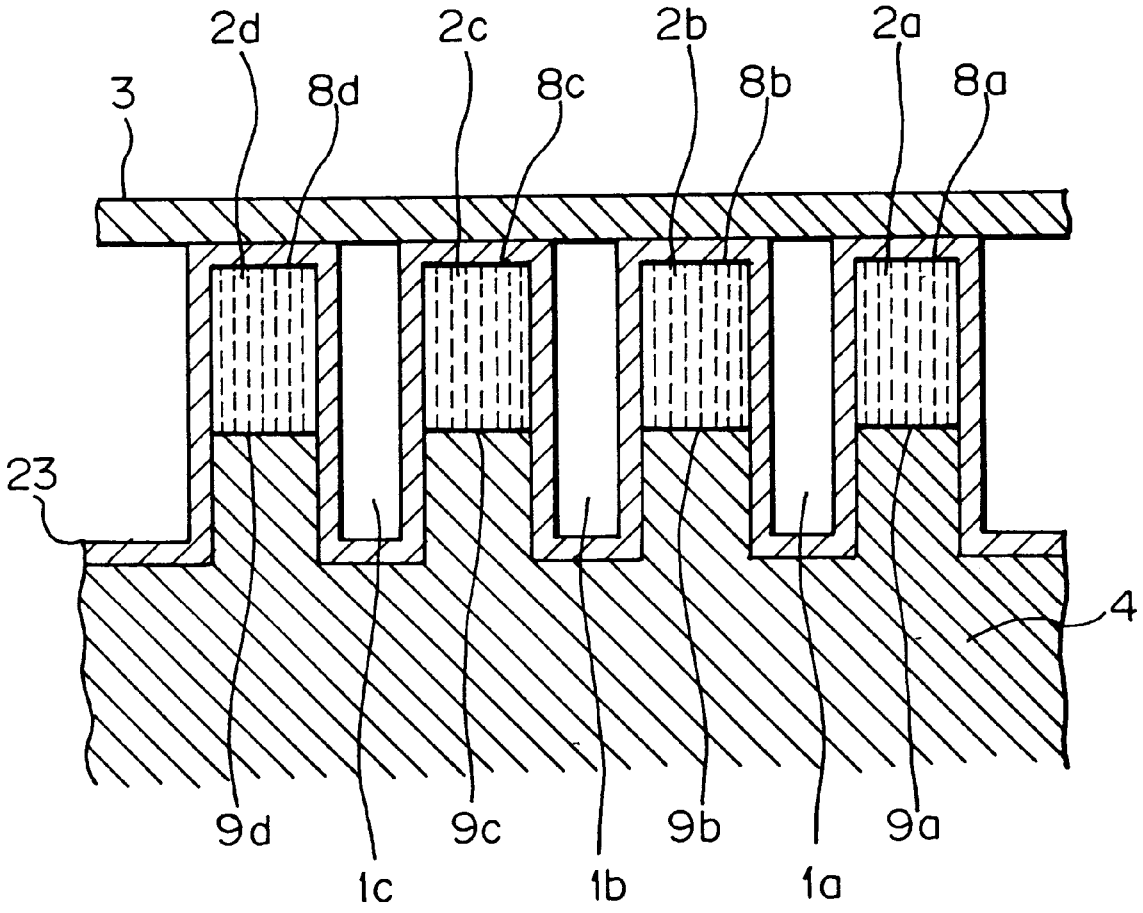
FIGS. 23 is a section showing a seventh embodiment of the print head included in the device of the present invention.
Figure 24A:
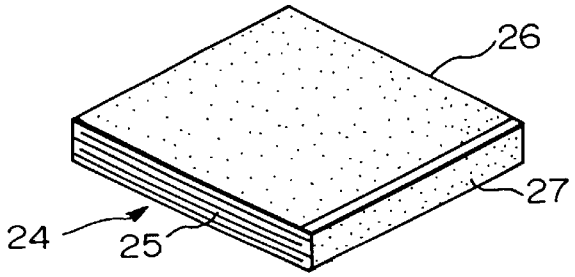
FIGS. 24, 25 and 26 are fragmentary sectional perspective views respectively showing an eighth, a ninth and tenth embodiment of the print head included in the device of the present invention.
Figure 24B:
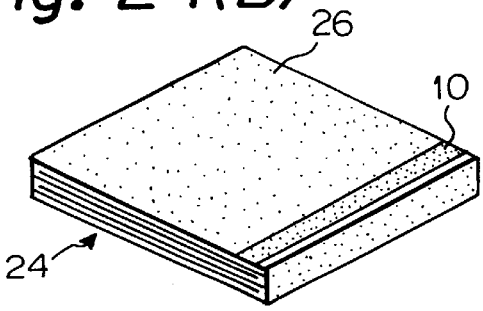
Figure 24C:
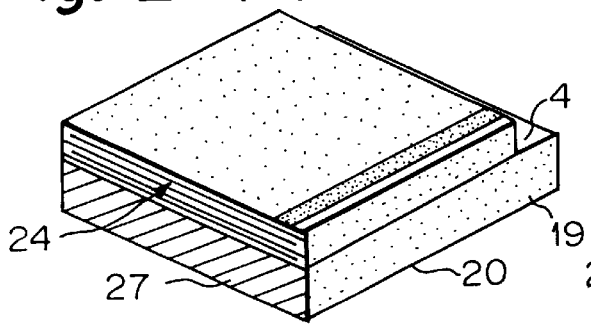
Figure 24D:
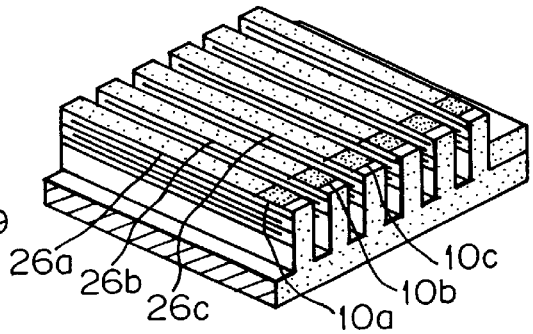
Figure 24E:
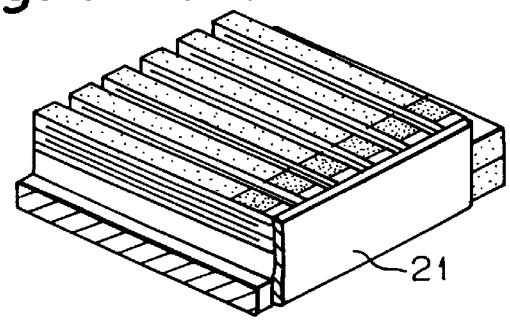
Figure 24F:
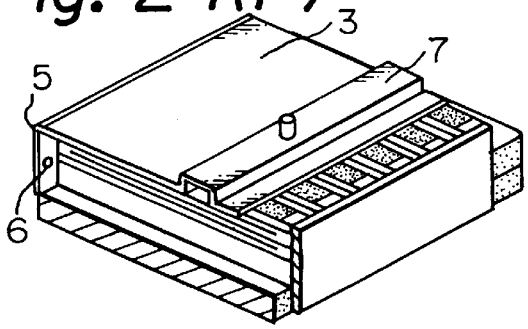
Figure 24G:
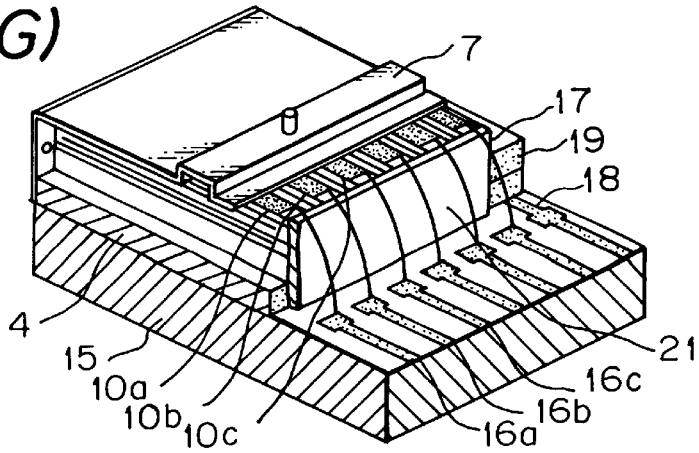

FIG. 23 shows a seventh embodiment of the present invention. This embodiment is identical with the first embodiment in the basic construction, basic dimensions and operation of the print head as well as the conditions and method for driving it. The difference is that in this embodiment the protection film formed by anodic oxidation and covering the electrodes 8*a*, 8*b*, 8*c* and so forth and electrodes 9*a*, 9*b* and 9*c* and so forth is replaced with a protection film 23. The protection film 23 protects such electrodes from the ink, not shown, filling the pressure chambers 1*a*, 1*b*, 1*c* and so forth. The protection film 23 is formed by sputtering silicon nitride. The rest of the procedure is the same as in the first embodiment.

Referring to FIG. 24, an eighth embodiment of the present invention will be described. As shown, in the illustrative embodiment, use is made of a laminate piezoelectric plate 24. The piezoelectric plate 24 is configured such that a plurality of electrodes 25 laminated therein are alternately electrically connected to outside electrodes 26 and 27. The plate 24 is 400 μm thick and made up of twenty layers spaced 20 μm from each other. In a step (B) shown in FIG. 24, a gold film is formed on the edges of the outside electrode 26 in order to form the pad 10. To form the pressure chambers, in a step (C), the under plate 4 is adhered to the laminate piezoelectric plate 24 by adhesive based on epoxy resin. The under plate 4 is formed of a piezoelectric material and 500 μm thick. A 0.5 μm thick tantalum film is formed on the end of the under plate 4 beforehand by sputtering tantalum, implementing the electrode 19. The outside plate 27 on the end of the piezoelectric plate 24 and the electrode 19 on the end of the under plate 4 are electrically connected by the conductive adhesive 20. Subsequently, in a step (D), a plurality of grooves are formed in the piezoelectric plate 24 by cutting at a pitch of 127 μm over the entire length of the plate 24. The grooves are 63.5 μm wide and 500 μm deep each. As a result, the outside electrode 26 and pad 10 are separated into electrodes 26*a*, 26*b*, 26*c* and so forth and pad portions 10*a*, 10*b*, 10*c* and so forth, respectively.

Subsequently, a film of silicon nitride is formed by sputtering as in the seventh embodiment. This is followed by a mounting procedure. First, in a step (E) shown in FIG. 24, the end plate 21 is adhered to the end of the above laminate by adhesive based on epoxy resin in such a manner as to block the rear ends of the grooves. Then, in a step (F), the nozzle plate 5 is adhered to the flush ends of the piezoelectric plate 24 and under plate 4 by adhesive based on epoxy resin. The nozzle plate 5 is formed of polyimide and 80 μm thick while the nozzles 6 formed in the plate 5 by excimer laser each has a diameter of 40 μm. In the above condition, the nozzles 6 are respectively brought into communication with the grooves formed in the piezoelectric plate 24 and under plate 4. The top plate 3 formed of polyimide and the ink pool 7 formed of PES are adhered to the top of the piezoelectric plate 24 by adhesive based on epoxy resin, covering the grooves of the plate 24.

Thereafter, in a step (G) shown in FIG. 24, the printed circuit board 15 is adhered to the bottom of the under plate 4. The circuit board 15 includes the lead terminals 16*a*, 16*b*, 16*c* and so forth for connecting the pad portions 10*a*, 10*b*, 10*c* and so forth and common electrode 19. The circuit board 15 is electrically connected to a driver, not shown. The pad portions and lead terminals are connected by bonding wires 17 formed of gold. The common electrode 19 on the end of the under plate 4 and the lead terminals are connected by the conductive paste 18. The portion of each groove between the end of the ink pool 7 and the end plate 21 is filled with epoxy resin, not shown. The bonded portions and the portions applied with the conductive paste are sealed by epoxy resin, although not shown specifically.

The eighth embodiment is identical with the first embodiment as to the operation of the print head and the method of driving it. In the eighth embodiment, the portions serving as the pressure chambers are each sized 63.5 μm, 500 μm×4 mm. A typical drive voltage in the stable discharge range available with the eighth embodiment is as low as 15 V.

Figure 25:
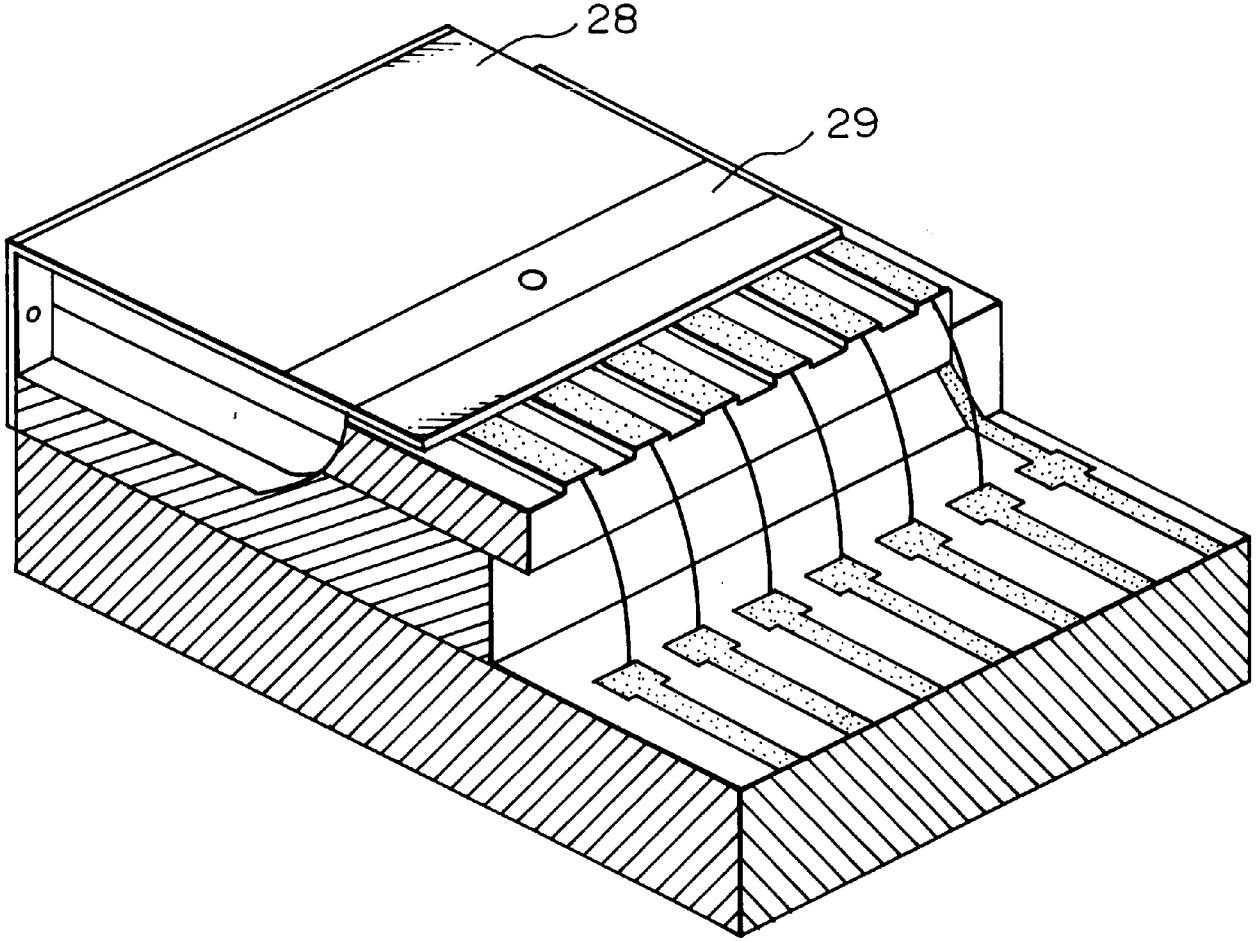

FIG. 25 shows a ninth embodiment of the present invention. This embodiment is also identical with the first embodiment as to the basic construction, basic dimensions and operation of the print head as well as the conditions and method for driving it. In the illustrative embodiment, a top plate 28 is partly thinned to form an ink pool 29. The top plate 28 is formed of the same material as the piezoelectric plate or PES or glass.

Figure 26:
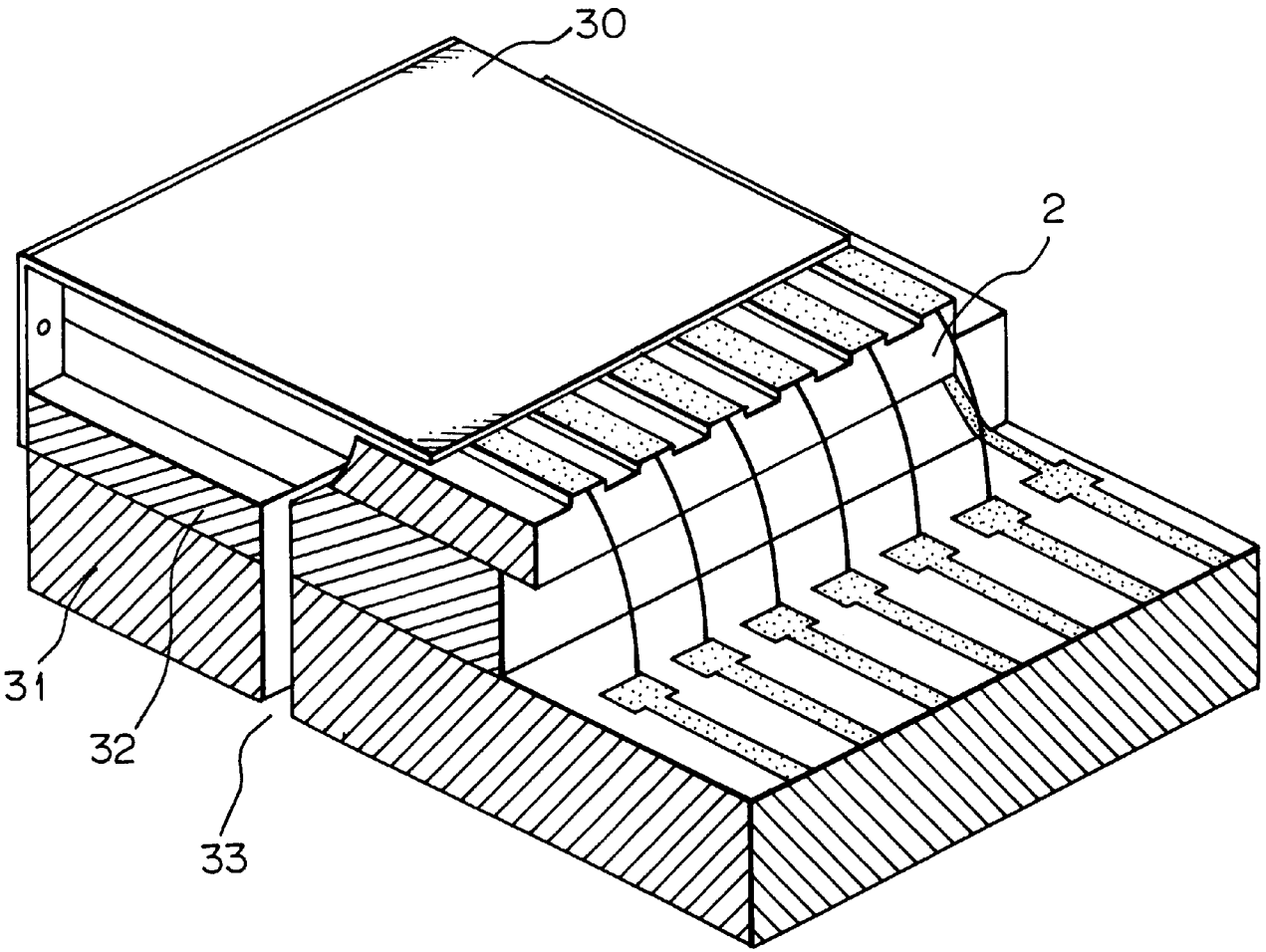
Figure 27:
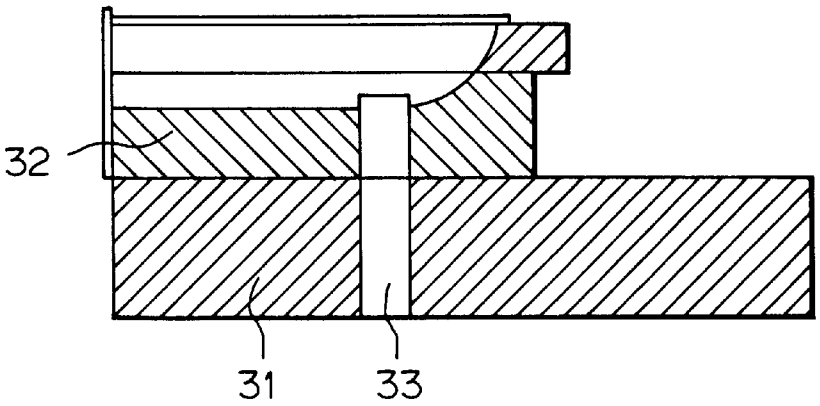
FIG. 27 is a section associated with FIG. 26.

FIGS. 26 and 27 show a tenth embodiment of the present invention. This embodiment is also identical with the first embodiment as to the operation of the print head and the method of driving it. In the illustrative embodiment, a top plate 30 covers the upper surface of the piezoelectric plate 2. An ink pool 33 is formed in a printed circuit board 31 and an under plate 32 by milling or similar machining or by laser. When the under plate 32 is implemented as a silicon substrate, the ink pool can be formed by the anisotropic etching of silicon.

In summary, it will be seen that the present invention provides an ink jet recording device and a method of producing the same which have various unprecedented advantages, as enumerated below.

(1) Two electrodes for applying a voltage to the side walls of a piezoelectric plate lie in the range of a pressure chamber, so that an electric field is prevented from acting on portions which do not contribute to the ejection of an ink drop. This obviates the waste of voltage and thereby realizes low voltage drive which reducing the size of the pressure chamber. All the grooves serve as pressure chambers without any slit or similar wasteful space intervening between them. This implements a multinozzle print head having a dense configuration. With such a print head, the recording device achieves a miniature and compact arrangement.

(2) A drive voltage is selected to be higher than a critical ejection voltage, but lower than a voltage twice a s high as the critical voltage. Alternatively, the displacement velocity of the piezoelectric element is selected to be higher than a critical ejection displacement velocity, but lower than a rate twice as high as the critical velocity, or energy to be applied is selected to be higher than a critical ejection energy, but lower than energy four times as high as the critical energy. This successfully obviates the interference of the drive voltage, displacement velocity or energy with nozzles adjoining a target nozzle. It follows that a power source of single polarity suffices and simplifies the construction and reduces the cost.

(3) The electric field is formed in the same direction as the polarization, so that an intense electric field can be formed without any reversal of the polarization. Therefore, a great displacement is achievable which reduces the required volume of each pressure chamber. The device is therefore dense, miniature and operable at high speed.

(4) A driver included in a specific control system has a resistor electrically parallel to the piezoelectric element. This eliminates the need for a switching device for discharging and thereby simplifies the circuit arrangement.

(5) In another specific control system, while a waveform generator outputs a voltage waveform having a rising portion and a falling portion, a switching circuit feeds it to the piezoelectric element by turning it on and off. A first and a second pulse are respectively output when the above voltage waveform rises and falls. The second pulse is generated when the output voltage of the waveform generator falls to a voltage equal to the voltage appearing when the first pulse goes low. The interval between the negative-going edge of the first pulse and the positive-going edge of the second pulse is controlled so as to control the amount of an ink drop to be ejected. The amount of an ink drop is variable while maintaining the velocity of the drop constant, if the output waveform of the waveform generator is matched to the characteristic of the print head and that of the ink.

(6) Because the direction of the electric field and that of polarization are coincident, polarization can be done only if a voltage is applied via electrodes formed on the opposite ends of the side walls of the piezoelectric body after the print head has been completed. This realizes a simple and cost-saving production procedure.

(7) Because polarization does not have to be effected beforehand, adhesion, CVD, sputtering and other high-temperature processes are applicable. Therefore, there can be used a production method and materials which are reliable and inexpensive.

(8) To form the pressure chambers, a flat top plate is simply adhered to the top of the piezoelectric plate formed with a plurality of grooves. It is, therefore, not necessary to accurately position the apexes of grooves and then join them together. This further reduces the production cost and enhances stable production.

(9) An oxide film on anode for protection simplifies the facilities, reduces the cost, and is extremely delicate and reliable.

Various modifications will become possible for those skilled in the art after receiving the teachings of the present disclosure without departing from the scope thereof. For example, in the first to sixth embodiments, the electrodes may be formed by the sputtering, CVD or vapor deposition of aluminum, titanium magnesium, niobium or zirconium. In the seventh and eighth embodiments, the electrodes may be formed by baking, plating, vapor deposition, sputtering or CVD of silver, silver palladium, platinum, nickel, gold or nichrome or alloy thereof. In the seventh and eighth embodiments, the protection layer may be formed by sputtering, CVD or dipping of $SiO_2$, $Si_3N_4$, BPSG, polyimide or high molecule material. In the third, sixth and eighth embodiments, the grooves may be formed not only by a cutting saw but also by a wire saw or laser assisted etching or similar chemical reaction.

Further, in all the embodiments shown and described, the pad may be formed by the plating or sputtering of gold, nickel or aluminum. For the under plate, use may be made of PZT, alumina ($Al_2O_3$), $Si_3N_4$, SiC, BN, ITO or similar ceramics, glass (SiO_), Si, tantalum, aluminum, titanium, magnesium, niobium, or zirconium. The top plate, may be made of the same material as the piezoelectric plate forming the pressure chambers, glass, ceramics or PES. In addition, the nozzle plate may be formed of the same material as the piezoelectric plate, glass, ceramics or nickel.

While the nozzles have been shown and described as being formed in the nozzle plate, they may alternatively be formed in the top plate if desired.

What is claimed is:

1. An ink jet recording device comprising:

a plurality of pressure chambers each being at least partially delimited, at both sides thereof, by side walls made of a dielectric material polarized in an up-and-down direction and flexible in an upper portion thereof;

a plurality of first electrodes respectively positioned on an upper surface of each side wall;

a plurality of second electrodes respectively positioned on a lower surface of each side wall;

an under plate connected to each of said side walls, said under plate defining the bottom portion of each pressure chamber, wherein each of said second electrodes is positioned between one of said side walls and said under plate;

a plurality of nozzles each being in fluid communication with a respective pressure chamber; and a control system electrically connected to said plurality of first electrodes and to said plurality of second electrodes for applying an electric field in a same direction as said direction of polarization of said side walls.

2. A device as claimed in claim 1, wherein said side walls define a portion of the height of said pressure chamber.

3. A device as claimed in claim 2, wherein each of said side walls are shared by adjacent pressure chambers.

4. A device as claimed in claim 3, wherein said side walls are expanded and then contracted to eject an ink drop through the respective nozzle.

5. A device as claimed in claim 4, wherein said control system applies to said side walls a drive voltage above a critical ejection voltage, but below twice said critical ejection voltage.

6. A device as claimed in claim 4, wherein said control system applies to said side walls a drive voltage waveform for causing said side walls to displace at a velocity above a critical ejection displacement velocity, but below a rate twice as high as said critical ejection displacement velocity.

7. A device as claimed in claim 4, wherein said control system applies to said side walls energy above a critical ejection energy, but below energy four times as high as said critical ejection energy.

8. A device as claimed in claim 5, 6 or 7, wherein every n-th nozzle (n being 2 or greater natural number) is located at a same level, and wherein every n-th pressure chamber is driven at a same timing.

9. A device as claimed in claim 5, 6 or 7, wherein each two nearby nozzles spaced by n nozzles (n being 2 or greater natural number) from adjoining two nozzles are located at a same level, and wherein each two nearby pressure chambers spaced by n pressure chambers from adjoining two chambers are driven at a same timing.

10. A device as claimed in claim 5, 6 or 7, wherein each two nearby nozzles spaced by 2n nozzles (n being 2 or greater natural number) from adjoining two nearby nozzles are located at a same level, and wherein each two nearby pressure chambers spaced by 2n pressure chambers from adjoining two nearby pressure chambers are driven at a same timing.

11. A device as claimed in claim 1, wherein said control system comprises data converting means for distributing print data meant for each of said pressure chambers to said side walls.

12. A device as claimed in claim 11, further comprising resistance generating means electrically parallel to each o f said side walls.

13. A device as claimed in claim 12, wherein said control system comprises control means for varying a pulse width in accordance with an amount of ink to be ejected, and feeding said pulse width to a driver.

14. A device as claimed in claim 11, wherein said control system comprises:

control means for generating a first and a second pulse and varying an interval between a negative-going edge of said first pulse and a positive-going edge of said second pulse;

waveform generating means for generating a voltage waveform having a rising portion and a falling portion; and switching means for applying said voltage waveform to said side walls while said first and second pulses are in a high level.

15. A device as claimed in claim 14, wherein said control means generates, in a single ink ejection cycle, said first pulse when said voltage waveform rises, and generates said second pulse when said voltage waveform falls to a voltage equal to a voltage appearing when said first pulse goes low.

16. A device as claimed in claim 15, wherein said waveform falls, after rising, at a rate sequentially increasing with an elapse of time.

17. A device as claimed in claim 1, wherein said dielectric material has a laminate structure.

18. A device as claimed in claim 1, wherein said plurality of first electrodes and said plurality of second electrodes are formed of any one of tantalum, aluminum, titanium, magnesium, niobium, and zirconium.

19. A device as claimed in claim 1, wherein said under plate has a periphery which extends beyond the outermost bounds of said plurality of side walls.

20. A device as claimed in claim 1, wherein said under plate includes an ink groove therein.

21. A device as claimed in claim 20, wherein said ink groove is in fluid communication with each of said pressure chambers.

22. A device as claimed in claim 1, wherein each of said pressure chambers includes a first height, and wherein each of said plurality of first electrodes is spaced apart from a respective one of said second electrodes by a distance which is less than the first height.

23. A device as claimed in claim 1, wherein each of said second electrodes is discrete from each of said plurality of first electrodes.

24. A device as claimed in claim 1, wherein a length of each of said side walls is adjacent to one of said pressure chambers.

25. An ink jet recording device comprising:

a plurality of side walls each made of a dielectric material polarized in an up-and-down direction, wherein each side wall is flexible and further includes a top end and a bottom end;

a plurality of pressure chambers, a portion of each pressure chamber being defined by two of said side walls such that adjacent pressure chambers share a common side wall;

a plurality of first electrodes, wherein one of said plurality of first electrodes is disposed on said top end of each side wall;

a second electrode disposed on said bottom end of each side wall;

an under plate connected to each of said side walls said under plate defining the bottom portion of each pressure chamber, wherein said second electrode is positioned between each side wall and said under plate; and a control system electrically connected to said plurality of first electrodes and to said second electrode for applying an electric field in the same direction as said direction of polarization of said side walls.

26. A device as claimed in claim 25, further comprising a plurality of nozzles each in fluid communication with a different pressure chamber.

27. A device as claimed in claim 25, wherein said under plate has a periphery which extends beyond the outermost bounds of said plurality of side walls.

28. A device as claimed in claim 25, wherein said under plate includes an ink groove therein.

29. A device as claimed in claim 28, wherein said ink groove is in fluid communication with each of said pressure chambers.

30. A device as claimed in claim 25, wherein said dielectric material of which said plurality of walls is made constitutes a piezoelectric material.

31. A device as claimed in claim 30, wherein said piezoelectric material is laminated.

32. A device as claimed in claim 31, wherein said piezoelectric material is laminated with a plurality of third electrodes.

33. A device as claimed in claim 25, wherein each of said pressure chambers includes a first height, and wherein each of said plurality of first electrodes is spaced apart from said second electrode by a distance which is less than the first height.

34. A device as claimed in claim 25, wherein said second electrode is discrete from each of said plurality of first electrodes.

35. A device as claimed in claim 25, wherein a length of each of said side walls is adjacent to one of said pressure chambers.

* * * * *

UNITED STATES PATENT AND TRADEMARK OFFICE

CERTIFICATE OF CORRECTION

PATENT NO. : 6,161,926
DATED : December 19, 2000
INVENTOR(S) : Koji Shigemura, Ota, Takashi It is certified that error appears in the above-identified patent and that said Letters Patent is hereby corrected as shown below:

Column 4,
Line 9, delete "148";
Line 10, after "148" insert -- , --;
Line 11, delete "abstruct" insert -- obstruct --
Column 6,
Line 45, delete "to" insert -- $t_o$ --
Line 46, delete "to" insert -- $t_o$ --

Column 8,
Line 36, delete "t he: insert -- the --

Column 10,
Line 28, delete "T" insert -- $t_i$ --
Column 11,
Line 1, de;ete "ta" insert -- $t_a$ --

Column 16,
Line 37. Delete "Sio__ "insert -- $Si^o{}_2$ --

Signed and Sealed this

Sixteenth Day of October, 2001

*Attest:*

Nicholas P. Godici

NICHOLAS P. GODICI
*Acting Director of the United States Patent and Trademark Office*

*Attesting Officer*